US005487838A

United States Patent [19]

Luciani et al.

[11] Patent Number: 5,487,838

[45] Date of Patent: Jan. 30, 1996

[54] REACTION PRODUCTS OF A BORON COMPOUND AND A PHOSPHOLIPID, AND LUBRICANT AND AQUEOUS FLUIDS CONTAINING SAME

[75] Inventors: Carmen V. Luciani, Wickliffe; Syed Q. A. Rizvi, Painesville, both of Ohio

[73] Assignee: The Lubrizol Corporation, Wickliffe, Ohio

[21] Appl. No.: 218,860

[22] Filed: Mar. 28, 1994

Related U.S. Application Data

[63] Continuation of Ser. No. 687,271, Apr. 18, 1991, abandoned.

[51] Int. Cl.[6] ..... C10M 139/00; C07F 9/02

[52] U.S. Cl. ..... 252/49.9; 252/49.3; 252/49.8; 252/78.5; 558/72

[58] Field of Search ..... 252/32.5, 49.9, 252/54.6; 558/72

[56] References Cited

U.S. PATENT DOCUMENTS

| | | | |
|---|---|---|---|
| 2,257,601 | 9/1941 | Hail et al. | 252/53 |
| 2,270,241 | 1/1942 | Adams | 252/49.9 |
| 2,295,192 | 9/1942 | Arveson | 252/53 |
| 2,373,733 | 4/1945 | Adams et al. | 252/53 |
| 2,408,090 | 9/1946 | Musher | 252/49.9 |
| 2,465,733 | 3/1949 | Levis | 260/403 |
| 3,085,100 | 4/1963 | Franklin | 260/403 |
| 3,252,908 | 5/1966 | Coleman | 252/49.9 |
| 3,284,409 | 11/1966 | Dorer | 252/49.9 |
| 4,305,853 | 12/1981 | Kronstein | 260/22 |
| 4,522,629 | 6/1985 | Horodysky | 44/53 |
| 4,529,528 | 7/1985 | Horodysky | 252/49.6 |
| 4,536,306 | 8/1985 | Horodysky | 252/32 |
| 4,557,844 | 12/1985 | Horodysky | 252/49.9 |
| 4,599,191 | 7/1986 | Horodysky | 252/32.5 |

FOREIGN PATENT DOCUMENTS

| | | |
|---|---|---|
| 0325977 | 1/1989 | European Pat. Off. . |
| 2125431 | 7/1983 | United Kingdom . |

OTHER PUBLICATIONS

Smallheer et al, Lubricant Additives, pp. 1–11, 1967.

*Primary Examiner*—Ellen M. McAvoy

*Attorney, Agent, or Firm*—Joseph P. Fischer; Frederick D. Hunter; James L. Cordek

[57] ABSTRACT

This invention relates to a composition prepared by reacting (A) a boron compound and (B) a phospholipid. These phospholipids are useful as lubricant additives for oil-base and water-base functional fluids. These materials act as anti-wear and/or extreme pressure agents. Further, these materials when incorporated into aqueous compositions have beneficial bacteriostatic effects, i.e., controlling bacterial growth.

38 Claims, No Drawings

REACTION PRODUCTS OF A BORON COMPOUND AND A PHOSPHOLIPID, AND LUBRICANT AND AQUEOUS FLUIDS CONTAINING SAME

This is a continuation of application Ser. No. 07/687,271 filed on 19 Apr. 1991, now abandoned.

FIELD OF THE INVENTION

This invention relates to novel compositions prepared by reacting a combination of at least one boron compound and at least one phospholipid, and lubricants and aqueous fluids containing the same.

INTRODUCTION TO THE INVENTION

Phospholipids, sometimes referred to as phosphatides and phospholipins, are lipids which contain a phosphoric acid or derivative thereof. Glycerophospholipids, have been referred to as phosphatides and phosphoglycerides, are any glycerophosphoric acid or derivative thereof with one or two acyl, alkenyl or alkyl groups attached to a glycerol residue. These materials may be prepared synthetically or may be derived from natural sources. Natural sources that produce phospholipids are commonly seeds as well as animal products such as eggs.

U.S. Pat. No. 3,284,409 issued to Dorer, relates to substituted succinic acid-boron-alkylene amine phosphatide derived additives and lubricating oils containing the same. The patent describes oil-soluble boron-containing compositions, such as boron-containing acylated amines, heated with phosphatides (lecithins).

SUMMARY OF THE INVENTION

This invention relates to novel compositions prepared by reacting a combination of (A) boron compounds and (B) phospholipids. The combination may also include (C) an amine, (D) an acylated nitrogen compound, (E) a carboxylic ester, (F) Mannich reaction products, or (G) a basic or neutral metal salt of an organic acid provided that when the acylated nitrogen compound (D) has a substituent with at least an average of forty carbon atoms, then the boron compound (A) is reacted with the phospholipid (B) to form an intermediate and the intermediate is reacted with (D). These reaction products are useful as lubricant additives for oil-based and water-based functional fluids. These materials act as anti-wear, extreme pressure and friction modifying agents. Further, these materials when incorporated into aqueous compositions have beneficial bacteriostatic effects, i.e., controlling bacterial growth.

DETAILED DESCRIPTION OF THE INVENTION

The term "hydrocarbyl" includes hydrocarbon as well as substantially hydrocarbon groups. Substantially hydrocarbon describes groups which contain non-hydrocarbon substituents which do not alter the predominately hydrocarbon nature of the group.

Examples of hydrocarbyl groups include the following:

(1) hydrocarbon substituents, that is, aliphatic (e.g., alkyl or alkenyl), alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, that is, those substituents containing non-hydrocarbon groups which, in the context of this invention, do not alter the predominantly hydrocarbon substituent; those skilled in the art will be aware of such groups (e.g., halo (especially chloro and fluoro), hydroxy, alkoxy, mercapto, alkylmercapto, nitro, nitroso, sulfoxy, etc.);

(3) hetero substituents, that is, substituents which will, while having a predominantly hydrocarbon character within the context of this invention, contain other than carbon present in a ring or chain otherwise composed of carbon atoms. Suitable heteroatoms will be apparent to those of ordinary skill in the art and include, for example, sulfur, oxygen, nitrogen and such substituents as, e.g., pyridyl, furyl, thienyl, imidazolyl, etc. In general, no more than about 2, preferably no more than one, non-hydrocarbon substituent will be present for every ten carbon atoms in the hydrocarbyl group. Typically, there will be no such non-hydrocarbon substituents in the hydrocarbyl group. Therefore, the hydrocarbyl group is purely hydrocarbon.

(A) Boron Compounds

This invention relates to novel compositions prepared by reacting a combination of (A) a boron compound and (B) a phospholipid. The boron compounds include boron oxide, boron oxide hydrate, boron trioxide, boron trifluoride, boron tribromide, boron trichloride, boron acids such as boronic acid (i.e., alkyl-$B(OH)_2$ or aryl-$B(OH)_2$), including methyl boronic acid, phenyl-boronic acid, cyclohexyl boronic acid, p-heptylphenyl boronic acid and dodecyl boronic acid, boric acid (i.e., $H_3BO_3$), tetraboric acid (i.e., $H_2B_4O_7$), metaboric acid (i.e., $HBO_2$), boron anhydrides, boron amides and various esters of such boron acids. The use of complexes of boron trihalide with ethers, organic acids, inorganic acids, or hydrocarbons is a convenient means of introducing the boron reactant into the reaction mixture. Such complexes are known and are exemplified by boron-trifluoride-triethyl orthoester, boron trifluoride-phosphoric acid, boron trichloride-chloroacetic acid, boron tribromide-dioxane, and boron trifluoridemethyl ethyl ether complexes.

The boron acid esters include especially mono-, di-, and tri-organic esters of boric acid with alcohols or phenols such as, e.g., methanol, ethanol, propanol, 1-octanol, benzyl alcohol, ethylene glycol, glycerol, Cellosolve, phenol. Lower alcohols, 1,2-glycols, and 1,3-glycols, i.e., those having less than about 8 carbon atoms are especially useful for preparing the boric acid esters for the purpose of this invention. Methods for preparing the esters of boron acid are known and disclosed in the art (such as "Chemical Reviews," pp. 959–1064, Vol. 56).

(B) Phospholipids

The phospholipids (B) of the present invention may be any lipid containing a phosphoric acid, such as lecithin or cephalin, preferably lecithin or derivatives thereof. Examples of phospholipids include phosphatidylcholine, phosphatidylserine, phosphatidylinositol, phosphatidylethanolamine, phosphotidic acid and mixtures thereof. Preferably, the phospholipids are glycerophospholipids, more preferably, glycero derivatives of the above list of phospholipids. Typically, the glycerophospholipids have one or two acyl, alkyl or alkenyl groups on a glycerol residue. The alkyl or alkenyl groups generally contain from about 8 to about 30 carbon atoms, preferably 8 to about 25, more preferably 12 to about 24. Example of these groups include octyl, dodecyl, hexadecyl, octadecyl, docosanyl, octenyl, dodecenyl, hexadecenyl and octadecenyl.

The acyl groups on the glycerophospholipids are generally derived from fatty acids. Fatty acids are acids having from about 8 to about 30 carbon atoms, preferably about 12 to about 24, more preferably about 12 to about 18. Examples of fatty acids include myristic, palmitic, stearic, oleic, linoleic, linolenic, arachidic, arachidonic acids, or mixtures thereof, preferably stearic, oleic, linoleic, and linolenic acids or mixtures thereof.

In the present invention, derivatives of phospholipids may also be used. Derivatives of phospholipids may be acylated or hydroxylated phospholipids. For instance, lecithin as well as acylated and hydroxylated lecithins may be used in the present invention. Acylated lecithins may be prepared by reacting an acylating agent with a lecithin. Acylating agents include acetic acid. An example of an acylated lecithin is Thermolec 200 acylated soya lecithin available from Ross & Rowe, Inc. of Decatur, Ill. Hydroxylated lecithins may also be used. Hydroxylated lecithins may be prepared by acidic or enzymatic hydrolysis. An example of hydroxylated lecithins is Thermolec 1018 hydroxylated lecithin available from Ross & Rowe, Inc.

Phospholipids may be prepared synthetically or derived from natural sources. Synthetic phospholipids may be prepared by methods known to those in the art. Naturally derived phospholipids are extracted by procedures known to those in the art. Phospholipids may be derived from animal or vegetable sources. The animal sources include fish, fish oil, shellfish, bovine brain or any egg, preferably chicken eggs. Vegetable sources include rapeseed, sunflower seed, peanut, palm kernel, cucurbit seed, wheat, barley, rice, olive, mango, avocado, palash, papaya, jangli, bodani, carrot, soybean, corn, and cottonseed, more preferably soybean, corn, sunflower and cottonseed. Phospholipids may be derived from microorganisms, includihg blue-green algae, green algae, bacteria grown on methanol or methane and yeasts grown on alkanes.

A useful phospholipid is derived from sunflower seeds. The phospholipid typically contains from about 35 to about 60% phosphatidylcholine, from about 20 to about 35% phosphatidylinositol, from about 1 to about 25% phosphatidic acid and from about 10 to about 25% phosphatidylethanolamine, wherein the percentages are by weight based on the total phospholipids. The fatty acid content is typically about 20–30% by weight palmitic acid, from about 2–10% by weight stearic acid, from about 15–25% by weight oleic acid and from about 40–55% by weight linoleic acid. In one embodiment, the phospholipid is derived from high oleic content sunflower seeds. These seeds typically produce phospholipids having oleic content greater than about 75%, preferably about 80%, more preferably about 85%. The fatty acid content of phospholipids derived from high oleic sunflower seeds generally are about 3.5–4.5% palmitic acid, about 3.0–5.5% stearic acid, about 75–95% oleic acid and about 5–15% linoleic acid. Generally, the phospholipid is derived from a meal produced from high oleic content sunflower seeds. The meal is available commercially under the tradename TRISUN® high oleic sunflower meal available from SVO Enterprises, 35585-B Curtiss Boulevard, Eastlake, Ohio 44095.

In one embodiment, phospholipids included in the present invention are represented by one of the formulae

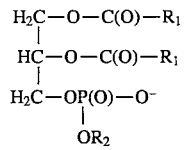

and

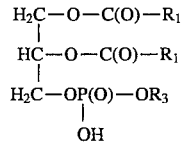

or mixtures thereof, wherein each $R_1$ is independently a hydrocarbyl group and each $R_2$ is independently selected from $—CH_2CH_2N^+(CH_3)_3$, $—CH_2CH_2N^+H_3$, $—CH_2CH(N^+H_3)COOH$, or, mixtures thereof, and each $R_3$ is independently $—C_6H_6(OH)_6$, hydrogen or mixtures thereof. Preferably each R is independently an alkyl, alkenyl or acyl group which have been described above.

Phospholipids and lecithins are described in detail in Encyclopedia of Chemcial Technology, Kirk and Othmer, 3rd Edition, in "Fats and Fatty Oils", Volume 9, pages 795–831 and in "Lecithins", Volume 14, pages 250–269. The above disclosures of phospholipids and lecithins are hereby incorporated by reference.

In one embodiment, the combination, used to prepare the compositions of the present invention, further comprises (C) at least one amine, (D) an acylated nitrogen-containing compound, (E) a carboxylic ester, (F) a Mannich reaction product or (G) a neutral or basic metal salt of an organic acid provided that when the acylated nitrogen compound (D) has a substituent with at least an average of forty carbon atoms, then the boron compound (A) is reacted with the phospholipid (B) to form an intermediate and the intermediate is reacted with (D).

(C) Amines

The amines include ammonia, monoamines or polyamines. The monoamines generally contain from 1 to about 24 carbon atoms, preferably 1 to about 12, and more preferably 1 to about 6. Examples of monoamines useful in the present invention include methylamine, ethylamine, propylamine, butylamine, octylamine, and dodecylamine. Examples of secondary amines include dimethylamine, diethylamine, dipropylamine, dibutylamine, methylbutylamine, ethylhexylamine, etc. Tertiary amines include trimethylamine, tributylamine, methyldiethylamine, ethyldibutylamine, etc.

In another embodiment, the monoamine may be a hydroxyamine. Typically, the hydroxyamines are primary, secondary or tertiary alkanolamines or mixtures thereof. Such amines can be represented by the formulae:

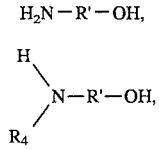

and

-continued

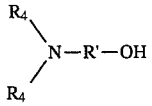

wherein each $R_4$ is independently a hydrocarbyl group of one to about eight carbon atoms or hydroxyhydrocarbyl group of two to about eight carbon atoms, preferably one to about four, and R' is a divalent hydrocarbyl group of about two to about 18 carbon atoms, preferably two to about four. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. Where two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each R is independently a methyl, ethyl, propyl, butyl, pentyl or hexyl group.

Examples of these alkanolamines include mono-, di-, and triethanolamine, diethylethanolamine, ethylethanolamine, butyldiethanolamine, etc.

The hydroxyamines can also be an ether N-(hydroxyhydrocarbyl)amine. These are hydroxypoly(hydrocarbyloxy) analogs of the above-described hydroxy amines (these analogs also include hydroxyl-substituted oxyalkylene analogs). Such N-(hydroxyhydrocarbyl) amines can be conveniently prepared by reaction of epoxides with aforedescribed amines and can be represented by the formulae:

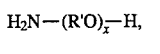

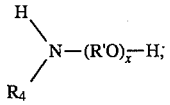

and

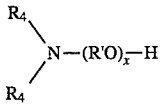

wherein x is a number from about 2 to about 15 and $R_4$ and R' are as described above. $R_4$ may also be a hydroxypoly(hydrocarbyloxy) group.

The amine may also be a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

Alkylene polyamines are represented by the formula

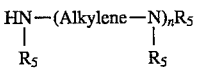

wherein n has an average value between about 1 and about 10, preferably about 2 to about 7, more preferably about 2 to about 5, and the "Alkylene" group has from 1 to about 10 carbon atoms, preferably about 2 to about 6, more preferably about 2 to about 4. $R_5$ is independently preferably hydrogen; or an aliphatic or hydroxy-substituted aliphatic group of up to about 30 carbon atoms. Preferably $R_5$ is defined the same as $R_4$.

Such alkylene polyamines include methylene polyamines, ethylene polyamines, butylene polyamines, propylene polyamines, pentylene polyamines, etc. The higher homologs and related heterocyclic amines such as piperazines and N-amino alkyl-substituted piperazines are also included. Specific examples of such polyamines are ethylene diamine, triethylene tetramine, tris-(2aminoethyl)amine, propylene diamine, trimethylene diamine, tripropylene tetramine, tetraethylene pentamine, hexaethylene heptamine, pentaethylenehexamine, etc.

Higher homologs obtained by condensing two or more of the above-noted alkylene amines are similarly useful as are mixtures of two or more of the aforedescribed polyamines.

Ethylene polyamines, such as some of those mentioned above, are useful. Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the aforedescribed piperazines. Ethylene polyamine mixtures are useful.

Other useful types of polyamine mixtures are those resulting from stripping of the above-described polyamine mixtures to leave as residue what is often termed "polyamine bottoms". In general, alkylene polyamine bottoms can be characterized as having less than two, usually less than 1% (by weight) material boiling below about 200° C. A typical sample of such ethylene polyamine bottoms obtained from the Dow Chemical Company of Freeport, Texas designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably DETA), 0.72% TETA, 21.74% tetraethylene pentaamine and 76.61% pentaethylene hexamine and higher (by weight). These alkylene polyamine bottoms include cyclic condensation products such as piperazine and higher analogs of diethylenetriamine, triethylenetetramine and the like.

Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. (See carboxylic ester dispersants.) Preferably the hydroxy compounds are polyhydric amines. Polyhydric amines include any of the above-described monoamines reacted with an alkylene oxide (e.g., ethylene oxide, propylene oxide, butylene oxide, etc.) having two to about 20 carbon atoms, preferably two to about four. Examples of polyhydric amines include tri-(hydroxypropyl)amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris(hydroxymethyl)aminomethane (THAM).

Polyamine reactants, which react with the polyhydric alcohol or amine to form the condensation products or condensed amines, are described above. Preferred polyamine reactants include triethylenetetramine (TETA), tetraethylenepentamine (TEPA), pentaethylenehexamine (PEHA), and mixtures of polyamines such as the above-described "amine bottoms".

The condensation reaction of the polyamine reactant with the hydroxy compound is conducted at an elevated temperature, usually about 60° C. to about 265° C., (preferably about 220° C. to about 250° C.) in the presence of an acid catalyst.

The amine condensates and methods of making the same are described in PCT publication W086/05501 which is incorporated by reference for its disclosure to the condensates and methods of making. The preparation of such polyamine condensates may occur as follows: A 4-necked 3-liter round-bottomed flask equipped with glass stirrer, thermowell, subsurface $N_2$ inlet, Dean-Stark trap, and Friedrich condenser is charged with: 1299 grams of HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and 727 grams of 40% aqueous tris(hydroxymethyl)aminomethane (THAM). This mixture is heated to 60° C. and 23 grams of 85% $H_3PO_4$ is added. The mixture is then heated to 120° C. over 0.6 hour. With $N_2$ sweeping, the mixture is then heated to 150° C. over 1.25 hour, then to 235° C. over 1 hour more, then held at 230°–235° C. for 5 hours, then heated to 240° C. over 0.75 hour, and then held at 240°–245° C. for 5 hours. The product is cooled to 150° C. and filtered with a diatomaceous earth filter aid. Yield: 84% (1221 grams).

In another embodiment, the polyamines are hydroxy-containing polyamines. Hydroxy-containing polyamine analogs of hydroxy monoamines, particularly alkoxylated alkylenepolyamines (e.g., N,N(diethanol)ethylene diamine) can also be used. Such polyamines can be made by reacting the above-described alkylene amines with one or more of the above-described alkylene oxides. Similar alkylene oxide-alkanolamine reaction products can also be used such as the products made by reacting the aforedescribed primary, secondary or tertiary alkanolamines with ethylene, propylene or higher epoxides in a 1.1 to 1.2 molar ratio. Reactant ratios and temperatures for carrying out such reactions are known to those skilled in the art.

Specific examples of alkoxylated alkylenepolyamines include N-(2-hydroxyethyl) ethylenediamine, N,N-bis(2-hydroxyethyl)-ethylene-diamine, 1-(2-hydroxyethyl)piperazine, mono(hydroxypropyl)-substituted tetraethylenepentamine, N-(3-hydroxybutyl)-tetramethylene diamine, etc. Higher homologs obtained by condensation of the above-illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

In another embodiment, the polyamine may be a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, iso-indoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkylsubstituted piperidines, piperazine, aminoalkylsubstituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

In another embodiment, the amine is a polyalkene-substituted amine. These polyalkene-substituted amines are well known to those skilled in the art. These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same.

Typically, polyalkene-substituted amines are prepared by reacting olefins and olefin polymers (polyalkenes) with amines (mono- or polyamines). The amines may be any of the amines described above. Examples of these compounds include poly(propylene)amine; N,N-dimethyl-N-poly(ethylene/propylene)amine, (50:50 mole ratio of monomers); polybutene amine; N,N-di(hydroxyethyl)-N-polybutene amine; N-(2-hydroxypropyl)-N-polybutene amine; N-polybutene-aniline; N-polybutenemorpholine; N-poly(butene-)ethylenediamine; N-poly(propylene)trimethylenediamine; N-poly(butene)diethylenetriamine; N',N'-poly(butene)tetraethylenepentamine; N,N-dimethyl-N'-poly(propylene)-1,3-propylenediamine and the like.

The polyalkene is characterized as containing from at least about 8 carbon atoms, preferably at least about 30, more preferably at least about 35 up to about 300 carbon atoms, preferably 200, more preferably 100. In one embodiment, the polyalkene is characterized by an Mn (number average molecular weight) value of at least about 500. Generally, the polyalkene is characterized by an Mn value of about 500 to about 5000, preferably about 800 to about 2500. In another embodiment Mn varies between about 500 to about 1200 or 1300.

The polyalkenes include homopolymers and interpolymers of polymerizable olefin monomers of 2 to about 16 carbon atoms; usually 2 to about 6, preferably 2 to about 4, more preferably 4. The olefins may be monoolefins such as ethylene, propylene, 1-butene, isobutene, and 1-octene; or a polyolefinic monomer, preferably diolefinic monomer, such 1,3-butadiene and isoprene. Preferably, the interpolymer is a homopolymer. An example of a preferred homopolymer is a polybutene, preferably a polybutene in which about 50% of the polymer is derived from isobutylene. The polyalkenes are prepared by conventional procedures.

(D) Acylated Nitrogen-Containing Compounds

The combination may also include an acylated nitrogen-containing compound. The acylated nitrogen-containing compounds include reaction products of hydro-carbyl-substituted carboxylic acylating agents such as substituted carboxylic acids or derivatives thereof. These compounds include imides, amides, amidic acid or salts, heterocycles (imidazolines, oxazolines, etc.), and mixtures thereof. In one embodiment, these compounds are useful as dispersants in lubricating compositions and have been referred to as nitrogen-containing carboxylic dispersants. The amines are described above, typically the amines are polyamines, preferably the amines are ethylene amines, amine bottoms or amine condensates.

The hydrocarbyl-substituted carboxylic acylating agent may be derived from a monocarboxylic acid or a polycarboxylic acid. Polycarboxylic acids generally are preferred. The acylating agents may be a carboxylic acid or derivatives of the carboxylic acid such as the halides, esters, anhydrides, etc., preferably acid, esters or anhydrides, more preferably anhydrides. Preferably the carboxylic acylating agent is a succinic acylating agent.

The hydrocarbyl-substituted carboxylic acylating agent includes agents which have a hydrocarbyl group derived from a polyalkene. The polyalkenes are described above.

In another embodiment, the hydrocarbyl group is derived from polyalkenes having an Mn value of at least about 1300 up to about 5000, and the Mw/Mn value is from about 1.5 to about 4, preferably from about 1.8 to about 3.6, more preferably about 2.5 to about 3.2.

The hydrocarbyl-substituted carboxylic acylating agents are prepared by a reaction of one or more polyalkenes with one or more unsaturated carboxylic reagent. The unsaturated carboxylic reagent generally contains an alpha-beta olefinic unsaturation. The carboxylic reagents may be carboxylic acids per se and functional derivatives thereof, such as anhydrides, esters, amides, imides, salts, acyl halides, and nitriles. These carboxylic acid reagents may be either monobasic or polybasic in nature. When they are polybasic they are preferably dicarboxylic acids, although tri- and tetracarboxylic acids can be used. Specific examples of useful monobasic unsaturated carboxylic acids are acrylic acid, methacrylic acid, cinnamic acid, crotonic acid, 2-phenylpropenoic acid, etc. Exemplary polybasic acids include maleic acid, fumaric acid, mesaconic acid, itaconic acid and citraconic acid. Generally, the unsaturated carboxylic acid or derivative is maleic anhydride or maleic or fumaric acid or ester, preferably, maleic acid or anhydride, more preferably maleic anhydride.

The polyalkene may be reacted with the carboxylic reagent such that there is at least one mole of reagent for each mole of polyalkene. Preferably, an excess of reagent is used. This excess is generally between about 5% to about 25%.

In another embodiment, the acylating agents are prepared by reacting the above described polyalkene with an excess of maleic anhydride to provide substituted succinic acylating agents wherein the number of succinic groups for each equivalent weight of substituent group is at least 1.3. The maximum number will not exceed 4.5. A suitable range is from about 1.4 to 3.5 and more specifically from about 1.4 to about 2.5 succinic groups per equivalent weight of substituent groups. In this embodiment, the polyalkene preferably has an Mn from about 1300 to about 5000 and a Mw/Mn of at least 1.5, as described above, the value of Mn is preferably between about 1300 and 5000. A more preferred range for Mn is from about 1500 to about 2800, and a most preferred range of Mn values is from about 1500 to about 2400. The preparation and use of substituted succinic acylating agents wherein the substituent is derived from such polyolefins are described in U.S. Pat. No. 4,234,435, the disclosure of which is hereby incorporated by reference.

The conditions, i.e., temperature, agitation, solvents, and the like, for reacting an acid reactant with a polyalkene, are known to those in the art. Examples of patents describing various procedures for preparing useful acylating agents include U.S. Pat. Nos. 3,215,707 (Rense); 3,219,666 (Norman et al); 3,231,587 (Rense); 3,912,764 (Palmer); 4,110,349 (Cohen); and 4,234,435 (Meinhardt et al); and U.K. 1,440,219. The disclosures of these patents are hereby incorporated by reference.

(E) Carboxylic Ester

In another embodiment, the combination, which forms the compositions of the present invention, may also include a carboxylic ester. These compounds are prepared by reacting at least one of the above hydrocarbyl-substituted carboxylic acylating agents with at least one organic hydroxy compound. In another embodiment, the ester dispersant is prepared by reacting the acylating agent with the above-described hydroxyamine. The carboxylic ester may be further reacted with any of the above-described amines.

The organic hydroxy compound includes compounds of the general formula $R^6(OH)_m$ wherein $R^6$ is a monovalent or polyvalent organic group joined to the —OH groups through a carbon bond, and m is an integer of from 1 to about 10 wherein the hydrocarbyl group contains at least about 8 aliphatic carbon atoms. The hydroxy compounds may be aliphatic compounds such as monohydric and polyhydric alcohols, or aromatic compounds such as phenols and naphthols. The aromatic hydroxy compounds from which the esters may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, etc.

The alcohols from which the esters may be derived preferably contain up to about 40 aliphatic carbon atoms, preferably from 2 to about 30, more preferably 2 to about 10. They may be monohydric alcohols such as methanol, ethanol, isooctanol, dodecanol, cyclohexanol, etc. In one embodiment, the hydroxy compounds are polyhydric alcohols, such as alkylene polyols. Preferably, the polyhydric alcohols contain from 2 to about 40 carbon atoms, more preferably 2 to about 20; and from 2 to about 10 hydroxyl groups, more preferably 2 to about 6. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol; preferably, diethylene glycol, triethylene glycol, glycerol, sorbitol, pentaerythritol and dipentaerythritol.

The polyhydric alcohols may be esterified with monocarboxylic acids having from 2 to about 30 carbon atoms, preferably about 8 to about 18, provided that at least one hydroxyl group remains unesterified. Examples of monocarboxylic acids include acetic, propionic, butyric and fatty carboxylic acids. The fatty monocarboxylic acids have from about 8 to about 30 carbon atoms and include octanoic, oleic, stearic, linoleic, dodecanoic and tall oil acids. Specific examples of these esterified polyhydric alcohols include sorbitol oleate, including mono- and dioleate, sorbitol stearate, including mono- and distearate, glycerol oleate, including glycerol mono-, di- and trioleate and erythritol octanoate.

The carboxylic esters may be prepared by any of several known methods. The method which is preferred because of convenience and the superior properties of the esters it produces, involves the reaction of a the carboxylic acylating agents described above with one or more alcohols or phenols in ratios of from about 0.5 equivalent to about 2 moles of hydroxy compound per equivalent of acylating agent. The esterification is usually carried out at a temperature above about 100° C., preferably between 150° C. and 300° C. The water formed as a by-product is removed by distillation as the esterification proceeds. The preparation of useful carboxylic ester dispersant is described in U.S. Pat. Nos. 3,522,179 and 4,234,435.

The carboxylic esters may be further reacted with at least one of the above described amines and preferably at least one of the above described polyamines. In one embodiment, the amount of amine which is reacted is an amount such that there is at least about 0.01 equivalent of the amine for each equivalent of acylating agent initially employed in the reaction with the alcohol. Where the acylating agent has been reacted with the alcohol in an amount such that there is at least one equivalent of alcohol for each equivalent of acylating agent, this small amount of amine is sufficient to react with minor amounts of non-esterified carboxyl groups which may be present. In one preferred embodiment, the nitrogen-containing carboxylic ester dispersants are prepared by reacting about 1.0 to 2.0 equivalents, preferably about 1.0 to 1.8 equivalents of hydroxy compounds, and up to about 0.3 equivalent, preferably about 0.02 to about 0.25 equivalent of polyamine per equivalent of acylating agent.

In another embodiment, the carboxylic acid acylating agent may be reacted simultaneously with both the alcohol and the amine. There is generally at least about 0.01 equivalent of the alcohol and at least 0.01 equivalent of the amine although the total amount of equivalents of the combination should be at least about 0.5 equivalent per equivalent of acylating agent. These nitrogen-containing carboxylic ester dispersant compositions are known in the art, and the preparation of a number of these derivatives is described in, for example, U.S. Pat. Nos. 3,957,854 and 4,234,435 which have been incorporated by reference previously.

The carboxylic esters and methods of making the same are known in the art and are disclosed in U.S. Pat. Nos. 3,219,666, 3,381,022, 3,522,179 and 4,234,435 which are hereby incorporated by reference for their disclosures of the preparation of carboxylic ester dispersants.

(F) Mannich Reaction Products

The combination may also include a Mannich product. Mannich products are formed by the reaction of at least one aldehyde, at least one of the above described amine and at least one hydroxyaromatic compound. The reaction may occur from room temperature to 225° C., usually from 50° to about 200° C. (75° C.–125° C. most preferred), with the amounts of the reagents being such that the molar ratio of hydroxyaromatic compound to formaldehyde to amine is in the range from about (1:1:1) to about (1:3:3).

The first reagent is a hydroxyaromatic compound. This term includes phenols (which are preferred), carbon-, oxygen-, sulfur- and nitrogen-bridged phenols and the like as well as phenols directly linked through covalent bonds (e.g. 4,4'-bis(hydroxy)biphenyl), hydroxy compounds derived from fused-ring hydrocarbon (e.g., naphthols and the like); and polyhydroxy compounds such as catechol, resorcinol and hydroquinone. Mixtures of one or more hydroxyaromatic compounds can be used as the first reagent.

The hydroxyaromatic compounds are those substituted with at least one, and preferably not more than two, aliphatic or alicyclic groups having at least about 6 (usually at least about 30, more preferably at least 50) carbon atoms and up to about 400 carbon atoms, preferably 300, more preferably 200. These groups may be derived from the above described polyalkenes. In one embodiment, the hydroxy aromatic compound is a phenol substituted with an aliphatic or alicyclic hydrocarbon-based group having an Mn of about 420 to about 10,000.

The second reagent is a hydrocarbon-based aldehyde, preferably a lower aliphatic aidehyde. Suitable aldehydes include formaldehyde, benzaldehyde, acetaldehyde, the butyraldehydes, hydroxybutyraldehydes and heptanals, as well as aldehyde precursors which react as aldehydes under the conditions of the reaction such as paraformaldehyde, paraldehyde, formalin and methal. Formaldehyde and its precursors (e.g., paraformaldehyde, trioxane) are preferred. Mixtures of aldehydes may be used as the second reagent.

The third reagent is any amine described above. Preferably the amine is a polyamine as described above.

Mannnich products are described in the following patents: U.S. Pat. No. 3,980,569; U.S. Pat. No. 3,877,899; and U.S. Pat. No. 4,454,059 (herein incorporated by reference for their disclosure to Mannich products).

The reaction product may also include a basic nitrogen-containing polymer. These polymers include polymer backbones which are functionalized by reacting with an amine source. A true or normal block copolymer or a random block copolymer, or combinations of both are utilized. They are hydrogenated before use in this invention to remove virtually all of their olefinic double bonds. Techniques for accomplishing this hydrogenation are well known to those of skill in the art. Briefly, hydrogenation is accomplished by contacting the copolymers with hydrogen at superatmospheric pressures in the presence of a metal catalyst such as colloidal nickel, palladium supported on charcoal, etc.

In general, it is preferred that these block copolymers, for reasons of oxidative stability, contain no more than about 5 percent and preferably no more than about 0.5 percent residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible unsaturation, as determined by the aforementioned analytical techniques.

The block copolymers typically have number average molecular weights (Mn) in the range of about 10,000 to about 500,000 preferably about 30,000 to about 200,000. The weight average molecular weight (Mw) for these copolymers is generally in the range of about 50,000 to about 500,000, preferably about 30,000 to about 300,000.

The amine source may be an unsaturated amine compound or an unsaturated carboxylic reagent which is capable of reacting with an amine. The unsaturated carboxylic reagents and amines are described above.

Examples of saturated amine compounds include N-(3,6-dioxaheptyl)maleimide, N-(3-dimethylaminopropyl)-maleimide, and N-(2-methoxyethoxyethyl)maleimide. Preferred amines are primary amine containing compounds. Exemplary of such primary amine-containing compounds include ammonia, N,N-dimethylhydrazine, methylamine, ethylamine, butylamine, 2-methoxyethylamine, N,N-dimethyl-1,3-propanediamine, N-ethyl-N-methyl-1,3-propanediamine, N-methyl-1,3-propanediamine, N-(3-aminopropyl-)morpholine, 3-methoxypropylamine, 3-isobutyoxypropylamine and 4,7-dioxyoctylamine, N-(3-aminopropyl)-N-1-methylpiperazine, N-(2-aminoethyl)piperazine, (2-aminoethyl)pyridines, aminopyridines, 2-aminoethylpyridines, 2-aminomethylfuran, 3-amino-2-oxotetrahydrofuran, N-(2-aminoethyl)pyrolidine, 2-aminomethylpyrrolidine, 1-methyl-2-aminomethylpyrrolidine, 1-aminopyrrolidine, 1-(3-aminopropyl)-2-methylpiperidine, 4-aminomethylpiperidine, N-(2-aminoethyl)morpholine, 1-ethyl-3-aminopiperidine, 1-aminopiperidine, N-aminomorpholine, and the like. Of these compounds, N-(3-aminopropyl)morpholine and N-ethyl-N-methyl-1,3-propanediamine are preferred with N,N-dimethyl-1,3-propanediamine being highly preferred.

Another group of primary amine-containing compounds are the various amine terminated polyethers. The amine terminated polyethers are available commercially from Texaco Chemical Company under the general trade designation "Jeffamine®". Specific examples of these materials include Jeffamine® M-600; M-1000; M-2005; and M-2070 amines.

Examples of the basic nitrogen-containing polymers are given in the following references:

| | |
|---|---|
| EP 171,167 | 3,687,905 |
| 3,687,849 | 4,670,173 |
| 3,756,954 | 4,320,012 |
| 4,320,019 | |

(herein incorporated by reference for their disclosure to the basic nitrogen-containing polymers).

(G) A Neutral, Basic Metal Salt

The combination may also include neutral, or basic metal salts. Preferably, the salts include alkali, alkaline earth or transition metal salts. Examples of metals of the salts include sodium, potassium, magnesium, calcium, barium, titanium, manganese, cobalt, nickel, copper, zinc, preferably sodium, potassium, calcium, magnesium, copper and zinc, more preferably zinc or magnesium cation, most preferably zinc.

In one embodiment, the salts are formed from metal compounds which are generally basic salts of metals. Generally, the metal compounds are oxides, hydroxides, chlorides, carbonates, phosphorus acids (phosphonic or phosphoric acid), and sulfur acid (sulfuric or sulfonic) salts of the metal cations listed above.

In another embodiment, the salts are basic salts, generally referred to as overbased salts. Overbased materials are single phase, homogeneous Newtonian systems characterized by a metal content in excess of that which would be present according to the stoichiometry of the metal and the particular organic compound reacted with the metal.

The amount of excess metal is commonly expressed in metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention have a metal ratio of about 1.1, preferably about 1.5, more preferably about 3 up to about 40, preferably up to about 30, more preferably up to about 20.

The overbased materials are prepared by reacting an acidic material, typically carbon dioxide, with a mixture comprising the acidic organic compound, a reaction medium comprising at least one inert, organic solvent for said organic material, a stoichiometric excess of the above-described metal compound, and a promoter. The acidic organic compounds useful in making the overbased compositions of the present invention include carboxylic acids, sulfonic acids, phosphorus containing acids, phenols or mixtures of two or more thereof. Preferably, the acidic organic compounds are carboxylic acids or sulfonic acids with sulfonic acids more preferred. The carboxylic and sulfonic acids may have substituent groups derived from the above described polyalkenes.

The carboxylic acids may be aliphatic or aromatic, mono- or polycarboxylic acid or acid-producing compounds. These carboxylic acids include lower molecular weight carboxylic acids (e.g., carboxylic acids having up to about 22 carbon atoms such as acids having about 4 to about 22 carbon atoms or tetrapropenyl-substituted succinic anhydride) as well as higher molecular weight carboxylic acids. Throughout this specification and in the appended claims, any reference to carboxylic acids is intended to include the acid-producing derivatives thereof such as anhydrides, lower alkyl esters, acyl halides, lactones and mixtures thereof unless otherwise specifically stated.

The carboxylic acids of this invention are preferably oil-soluble. Usually, in order to provide the desired oil-solubility, the number of carbon atoms in the carboxylic acid should be at least about 8, more preferably at least about 18, more preferably at least about 30, more preferably at least about 50. Generally, these carboxylic acids do not contain more than about 400 carbon atoms per molecule.

The lower molecular weight monocarboxylic acids contemplated for use in this invention include saturated and unsaturated acids. Examples of such useful acids include dodecanoic acid, decanoic acid, oleic acid, stearic acid, linoleic acid, tall oil acid, etc. Mixtures of two or more such agents can also be used. An extensive discussion of these acids is found in Kirk- Othmer "Encyclopedia of Chemical Technology" Third Edition, 1978, John Wiley & Sons New York, pp. 814–871; these pages being incorporated herein by reference.

The monocarboxylic acids include isoaliphatic acids. Such acids often contain a principal chain having from about 14 to about 20 saturated, aliphatic carbon atoms and at least one but usually no more than about four pendant acyclic lower alkyl groups. Specific examples of such isoaliphatic acids include 10-methyl-tetradecanoic acid, 3-ethyl-hexadecanoic acid, and 8-methyl-octadecanoic acid.

The isoaliphatic acids include mixtures of branch-chain acids prepared by the isomerization of commercial fatty acids (oleic, linoleic or tall oil acids) of, for example, about 16 to about 20 carbon atoms. The higher molecular weight mono- and polycarboxylic acids suitable for use in making the overbased salts (A) are well known in the art and have been described in detail, for example, in the following U.S., British and Canadian patents: U.S. Pat. Nos. 3,024,237; 3,172,892; 3,219,666; 3,245,910; 3,271,310; 3,272,746; 3,278,550; 3,306,907; 3,312,619; 3,341,542; 3,367,943; 3,374,174; 3,381,022; 3,454,607; 3,470,098; 3,630,902; 3,755,169; 3,912,764; and 4,368,133; British Patents 944, 136; 1,085,903; 1,162,436; and 1,440,219; and Canadian Patent 956,397. These patents are incorporated herein by reference for their disclosure of higher molecular weight mono- and polycarboxylic acids and methods for making the same.

Illustrative carboxylic acids include palmitic acid, stearic acid, myristic acid, oleic acid, linoleic acid, behenic acid, hexatriacontanoic acid, tetrapropylene-substituted glutaric acid, polyisobutene (Mn=200–1,500, preferably 300–1,000)-substituted succinic acid, polypropylene, (Mn=200–1,000, preferably 300–900)-substituted succinic acid, octadecyl-substituted adipic acid, chlorostearic acid, 9-methylstearic acid, dichlorostearic acid, stearyl-benzoic acid, eicosane-substituted naphthoic acid, dilauryl-decahydronaphthalene carboxylic acid, mixtures of these acids, their alkali and alkaline earth metal salts, and/or their anhydrides. A preferred group of aliphatic fatty acids includes the saturated and unsaturated higher fatty acids containing from about 12 to about 30 carbon atoms. Illustrative of these acids are lauric acid, palmitic acid, oleic acid, linoletic acid, linolenic acid, oleostearic acid, stearic acid, myristic acid, and undecalinic acid, alpha-chlorostearic acid, and alphanitrolauric acid.

In another embodiment, the carboxylic acid is an alkylalkyleneglycol-acetic acid, more preferably alkylpoly-ethyleneglycol-acetic acid. Some specific examples of these compounds include: iso-stearylpentaethyleneglycolacetic acid; iso-stearyl-O-$(CH_2CH_2O)_5CH_2CO_2Na$; lauryl-O-$(CH_2CH_2O)_{2.5}$-$CH_2CO_2H$; lauryl-O-$(CH_2CH_2O)_{3.3}CH_2CO_2H$;

oleyl-O-(CH $_2$C-H$_2$O)$_4$-CH$_2$CO$_2$H; lauryl-O-(CH$_2$CH$_2$O)$_{4.5}$CH$_2$CO$_2$H; lauryl-O-(CH $_2$CH$_2$O)-$_{10}$CH$_2$CO$_2$H; lauryl-O-(CH$_2$CH$_2$O)$_{16}$CH$_2$CO$_2$H; octyl-phenyl-O-(CH$_2$CH$_2$O)$_8$CH$_2$CO$_2$H; octyl-phenyl-O-(CH$_2$CH$_2$O)$_{19}$CH$_2$CO$_2$H; 2-octyl-decanyl-O-(CH$_2$CH$_2$O)$_6$CH$_2$CO$_2$H. These acids are available commercially from Sandoz Chemical under the tradename Sandopan acids.

In a preferred embodiment, the carboxylic acids are aromatic carboxylic acids. A group of useful aromatic carboxylic acids are those of the formula

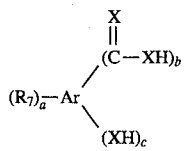

wherein $R_7$ is an aliphatic hydrocarbyl group of preferably about 4 to about 400 carbon atoms, a is a number in the range of zero to about 4, Ar is an aromatic group, each X is independently sulfur or oxygen, preferably oxygen, b is a number in the range of from 1 to about 4, c is a number in the range of zero to about 4, usually 1 to 2, with the proviso that the sum of a, b and c does not exceed the number of valences of Ar. Preferably, $R_7$ and a are such that there is an average of at least about 8 aliphatic carbon atoms provided by the $R_7$ groups.

The $R_7$ group is a hydrocarbyl group that is directly bonded to the aromatic group Ar. $R_7$ preferably contains about 6 to about 80 carbon atoms, preferably about 6 to about 30 carbon atoms, more preferably about 8 to about 25 carbon atoms, and advantageously about 8 to about 15 carbon atoms. Examples of $R_7$ groups include butyl, isobutyl, pentyl, octyl, nonyl, dodecyl, 5-chlorohexyl, 4-ethoxypentyl, 3-cyclohexyloctyl, 2,3,5-trimethylheptyl, and substituents derived from polymerized olefins such as polyethylenes, polypropylenes, polyisobutylenes, ethylene-propylene copolymers, chlorinated olefin polymers, oxidized ethylene-propylene copolymers, propylene tetramer and tri(isobutene).

Examples of the $R_7$ groups include butyl, isobutyl, pentyl, octyl, nonyl, dodecyl, and substituents derived from the above-described polyalkenes such as polyethylenes, polypropylenes, polyisobutylenes, ethylene-propylene copolymers, oxidized ethylene-propylene copolymers, and the like.

The aromatic group Ar may have the same structure as any of the aromatic groups Ar discussed below. Examples of the aromatic groups that are useful herein include the polyvalent aromatic groups derived from benzene, naphthalene, anthracene, etc., preferably benzene. Specific examples of Ar groups include phenylenes and naphthylene, e.g., methylphenylenes, ethoxyphenylenes, isopropylphenylenes, hydroxyphenylenes, dipropoxynaphthylenes, etc.

Within this group of aromatic acids, a useful class of carboxylic acids are those of the formula

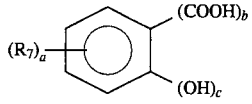

wherein $R_7$ is defined above, a is a number in the range of from zero to about 4, preferably 1 to about 3; b is a number in the range of 1 to about 4, preferably 1 to about 2, c is a number in the range of zero to about 4, preferably 1 to about 2, and more preferably 1; with the proviso that the sum of a, b and c does not exceed 6. Preferably, $R_7$ and a are such that the acid molecules contain at least an average of about 12 aliphatic carbon atoms in the aliphatic hydrocarbon substituents per acid molecule. Preferably, b and c are each one and the carboxylic acid is a salicylic acid.

The salicylic acids preferably are aliphatic hydrocarbon-substituted salicyclic acids wherein each aliphatic hydrocarbon substituent contains an average of at least about 8 carbon atoms per substituent and 1 to 3 substituents per molecule. Overbased salts prepared from such salicyclic acids wherein the aliphatic hydrocarbon substituents are derived from the above-described polyalkenes, particularly polymerized lower 1-mono-olefins such as polyethylene, polypropylene, polyisobutylene, ethylene/propylene copolymers and the like and having average carbon contents of about 30 to about 400 carbon atoms are particularly useful.

The above aromatic carboxylic acids are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791.

The sulfonic acids useful in making the overbased salts include the sulfonic and thiosulfonic acids. Generally they are salts of sulfonic acids. The sulfonic acids include the mono- or polynuclear aromatic or cycloaliphatic compounds. The oil-soluble sulfonates can be represented for the most part by one of the following formulae: $R_8$-T-$(SO_3)_a$, and $R_9$-$(SO_3)_b$, wherein T is a cyclic nucleus such as, for example, benzene, naphthalene, anthracene, diphenylene oxide, diphenylene sulfide, petroleum naphthenes, etc.; $R_8$ is an aliphatic group such as alkyl, alkenyl, alkoxy, alkoxyalkyl, etc.; $(R_8)$+T contains a total of at least about 15 carbon atoms; and $R_9$ is an aliphatic hydrocarbyl group containing at least about 15 carbon atoms. Examples of $R_9$ are alkyl, alkenyl, alkoxyalkyl, carboalkoxyalkyl, etc. Specific examples of $R_9$ are groups derived from petrolatum, saturated and unsaturated paraffin wax, and the above-described polyalkenes. The groups T, $R_8$, and $R_9$ in the above Formulae can also contain other inorganic or organic substituents in addition to those enumerated above such as, for example, hydroxy, mercapto, halogen, nitro, amino, nitroso, sulfide, disulfide, etc. In the above Formulae, a and b are at least 1.

Illustrative examples of these sulfonic acids include monoeicosane-substituted naphthalene sulfonic acids, dodecylbenzene sulfonic acids, didodecylbenzene sulfonic acids, dinonylbenzene sulfonic acids, cetylchlorobenzene sulfonic acids, dilauryl beta-naphthalene sulfonic acids, the sulfonic acid derived by the treatment of polyisobutene having a number average molecular weight (Mn) in the range of 500 to 5000, preferably 800 to 2000, more preferably about 1500 with chlorosulfonic acid, nitronaphthalene sulfonic acid, paraffin wax sulfonic acid, cetylcyclopentane, sulfonic acid, lauryl-cyclohexane sulfonic acids, polyethylene (Mn=300–1,000, preferably 750) sulfonic acids, etc. Normally the aliphatic groups will be alkyl and/or alkenyl groups such that the total number of aliphatic carbons is at least about 8, preferably at least 12.

A preferred group of sulfonic acids are mono-, di-, and tri-alkylated benzene and naphthalene (including hydrogenated forms thereof) sulfonic acids. Illustrative of synthetically produced alkylated benzene and naphthalene sulfonic acids are those containing alkyl substituents having from about 8 to about 30 carbon atoms, preferably about 12 to about 30 carbon atoms, and advantageously about 24 carbon atoms. Such acids include di-isododecyl-benzene sulfonic acid, polybutene-substituted sulfonic acid, polypropylene-substituted sulfonic acids of Mn=300–1000, preferably 500–700, cetylchlorobenzene sulfonic acid, di-cetylnaphthalene sulfonic acid, di-lauryldiphenylether sulfonic acid, diisononylbenzene sulfonic acid, di-isooctadecylbenzene sulfonic acid, stearylnaphthalene sulfonic acid, and the like.

Specific examples of oil-soluble sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax-substituted sulfonic and polysulfonic acids of, e.g., benzene, naphthalene, phenol, diphenyl ether, naphthalene disulfide, etc.; other substituted sulfonic acids such as alkyl benzene sulfonic acids (where the alkyl group has at least 8 carbons), cetylphenol mono-sulfide sulfonic acids, dilauryl beta naphthyl sulfonic acids, and alkaryl sulfonic acids such as dodecyl benzene "bottoms" sulfonic acids.

Dodecyl benzene "bottoms" sulfonic acids are the material leftover after the removal of dodecyl benzene sulfonic acids that are used for household detergents. These materials are generally alkylated with higher oligomers. The bottoms may be straight-chain or branched-chain alkylates with a straight-chain dialkylate preferred.

The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol 19 pp 291 et seq. published by John Wiley & Sons, N.Y. (1969).

The phosphorus-containing acids useful in making the salts of the present invention include any phosphorus acids such as phosphoric acid or esters; and thiophosphorus acids or esters, including mono and dithiophosphorus acids or esters. Preferably, the phosphorus acids or esters contain at least one, preferably two, hydrocarbyl groups containing from 1 to about 50 carbon atoms, typically 1 to about 30, preferably 3 to about 18, more preferably about 4 to about 8.

In one embodiment, the phosphorus-containing acids are dithiophosphoric acids which are readily obtainable by the reaction of phosphorus pentasulfide ($P_2S_5$) and an alcohol or a phenol. The reaction involves mixing at a temperature of about 20° C. to about 200° C. four moles of alcohol or a phenol with one mole of phosphorus pentasulfide. Hydrogen sulfide is liberated in this reaction. The oxygen-containing analogs of these acids are conveniently prepared by treating the dithioic acid with water or steam which, in effect, replaces one or both of the sulfur atoms with oxygen.

In a preferred embodiment, the phosphorus-containing acid is the reaction product of the above polyalkene and phosphorus sulfide. Useful phosphorus sulfide-containing sources include phosphorus pentasulfide, phosphorus sesquisulfide, phosphorus heptasulfide and the like.

The reaction of the polyalkene and the phosphorus sulfide generally may occur by simply mixing the two at a temperature above 80° C., preferably between 100° C. and 300° C. Generally, the products have a phosphorus content from about 0.05% to about 10%, preferably from about 0.1% to about 5%. The relative proportions of the phosphorizing agent to the olefin polymer is generally from 0.1 part to 50 parts of the phosphorizing agent per 100 parts of the olefin polymer.

The phosphorus-containing acids useful in the present invention are described in U.S. Pat. No. 3,232,883 issued to Le Suer. This reference is herein incorporated by reference for its disclosure to the phosphorus-containing acids and methods for preparing the same.

The phenols useful in making the overbased salts of the invention can be represented by the formula $(R_7)_a$-Ar-$(OH)_b$, wherein $R_7$ is defined above; Ar is an aromatic group; a and b are independently numbers of at least one, the sum of a and b being in the range of two up to the number of displaceable hydrogens on the aromatic nucleus or nuclei of Ar. Preferably, a and b are independently numbers in the range of 1 to about 4, more preferably 1 to about 2. $R_7$ and a are preferably such that there is an average of at least about 8 aliphatic carbon atoms provided by the $R_9$ groups for each phenol compound.

While the term "phenol" is used herein, it is to be understood that this term is not intended to limit the aromatic group of the phenol to benzene. Accordingly, it is to be understood that the aromatic group as represented by "Ar", as well as elsewhere in other formulae in this specification and in the appended claims, can be mononuclear such as a phenyl, a pyridyl, or a thienyl, or polynuclear. The polynuclear groups can be of the fused type wherein an aromatic nucleus is fused at two points to another nucleus such as found in naphthyl, anthranyl, etc. The polynuclear group can also be of the linked type wherein at least two nuclei (either mononuclear or polynuclear) are linked through bridging linkages to each other. These bridging linkages can be chosen from the group consisting of alkylene linkages, ether linkages, keto linkages, sulfide linkages, polysulfide linkages of 2 to about 6 sulfur atoms, etc.

The number of aromatic nuclei, fused, linked or both, in Ar can play a role in determining the integer values of a and b. For example, when Ar contains a single aromatic nucleus, the sum of a and b is from 2 to 6. When Ar contains two aromatic nuclei, the sum of a and b is from 2 to 10. With a tri-nuclear Ar moiety, the sum of a and b is from 2 to 15. The value for the sum of a and b is limited by the fact that it cannot exceed the total number of displaceable hydrogens on the aromatic nucleus or nuclei of Ar.

The promoters, that is, the materials which facilitate the incorporation of the excess metal into the overbased material, are also quite diverse and well known in the art. A particularly comprehensive discussion of suitable promoters is found in U.S. Pat. Nos. 2,777,874, 2,695,910, 2,616,904, 3,384,586 and 3,492,231. These patents are incorporated by reference for their disclosure of promoters. In one embodiment, promoters include the alcoholic and phenolic promoters. The alcoholic promoters include the alkanols of one to about 12 carbon atoms such as methanol, ethanol, amyl alcohol, octanol, isopropanol, and mixtures of these and the like. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

Acidic materials, which are reacted with the mixture of acidic organic compound, promoter, metal compound and reactive medium, are also disclosed in the above cited patents, for example, U.S. Pat. No. 2,616,904. Included within the known group of useful acidic materials are liquid acids such as formic acid, acetic acid, nitric acid, boric acid, sulfuric acid, hydrochloric acid, hydrobromic acid, carbamic acid, substituted carbamic acids, etc. Acetic acid is a very useful acidic material although inorganic acidic compounds such as HCl, $SO_2$, $SO_3$, $CO_2$, $H_2S$, $N_2O_3$, etc., are ordinarily employed as the acidic materials. Preferred acidic materials are carbon dioxide and acetic acid, more preferably carbon dioxide.

The methods for preparing the overbased materials as well as an extremely diverse group of overbased materials are well known in the prior art and are disclosed, for example, in the following U.S. Pat. Nos.: 2,616,904; 2,616,905; 2,616,906; 3,242,080; 3,250,710; 3,256,186; 3,274,135; 3,492,231; and 4,230,586. These patents disclose processes, materials which can be overbased, suitable metal bases, promoters, and acidic materials, as well as a variety of specific overbased products useful in producing the disperse systems of this invention and are, accordingly, incorporated herein by reference for these disclosures.

The temperature at which the acidic material is contacted with the remainder of the reaction mass depends to a large measure upon the promoting agent used. With a phenolic promoter, the temperature usually ranges from about 80° C. to about 300° C., and preferably from about 100° C. to about 200° C. When an alcohol or mercaptan is used as the promoting agent, the temperature usually will not exceed the reflux temperature of the reaction mixture and preferably will not exceed about 100° C.

The above (D) acylated nitrogen compounds, (E) carboxylic esters, (F) Mannich products and (G) basic nitrogen-containing polymers may be post-treated with one or more post-treating reagents selected from the group consisting of boron compounds (discussed above), carbon disulfide, hydrogen sulfide, sulfur, sulfur chlorides, alkenyl cyanides, carboxylic acid acylating agents, aldehydes, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulfides, phosphorus oxides, phosphoric acid, hydrocarbyl thiocyanates, hydrocarbyl isocyanates, hydrocarbyl isothiocyanates, epoxides, episulfides, formaldehyde or formaldehyde-producing compounds with phenols, and sulfur with phenols.

The following U.S. Patents are expressly incorporated herein by reference for their disclosure of posttreating processes and post-treating reagents applicable to the carboxylic derivative compositions of this invention: U.S. Pat. Nos. 3,087,936; 3,254,025; 3,256,185; 3,278,550; 3,282,955; 3,284,410; 3,338,832; 3,533,945; 3,639,242; 3,708,522; 3,859,318; 3,865,813; etc. U.K. Patent Nos. 1,085,903 and 1,162,436 also describe such processes.

In one embodiment, (D) through (G) are post-treated with at least one boron compound described above. The reaction of the compound with the boron compounds can be effected simply by mixing the reactants at the desired temperature. Ordinarily it is preferably between about 50° C. and about 250° C. In some instances it may be 25° C. or even lower. The upper limit of the temperature is the decomposition point of the particular reaction mixture and/or product.

The amount of boron compound used to post-treat (D)–(G) generally is sufficient to provide from about 0.1 to about 10 atomic proportions of boron for each equivalent of (D) through (G) such as the atomic proportion of nitrogen or hydroxyl group. The preferred amounts of reactants are such as to provide from about 0.5 to about 2 atomic proportions of boron for each equivalent of nitrogen or hydroxyl group. To illustrate, the amount of a boron compound having one boron atom per molecule to be used with one mole of a acylated nitrogen compound having five nitrogen atoms per molecule is within the range from about 0.1 mole to about 50 moles, preferably from about 0.5 mole to about 10 moles.

The compositions of the present invention may be prepared by reacting (A) a boron compound and (B) a phospholipid. Further, the composition may be prepared by reacting (A) a boron compound with a mixture of (B) a phospholipid and one of the above-described (C) an amine, (D) an acylated nitrogen compound, (E) a carboxylic ester, (F) a Mannich reaction product and (G) a basic nitrogen-containing polymer or derivatives thereof. The mixture may be simply a mixture of these components or may be a salt or partial salt of these components. In another embodiment, the composition may be prepared by reacting (A) a boron compound with (B) a phospholipid to form an intermediate reaction product. The intermediate product is then reacted with one of the above-described (C) through (G).

In another embodiment, the compositions of the present invention are prepared by reacting (A) a boron compound with one of the above-described (C) through (G) to form an intermediate. The intermediate is then reacted with (B) a phospholipid provided that when the acylated nitrogen compound (D) has a substituent with at least an average of 40 carbon atoms, then the boron compound (A) is reacted with the phospholipid (B) to form an intermediate and the intermediate is reacted with (D). When the acylated nitrogen-containing compound contains a substituent with no more than an average of about 40 carbon atoms, it must be understood that the acylated nitrogen-containing compound does not have to have a substituent with an average number of carbon atoms. The substituent may have a specific single number of carbon atoms, e.g. 18 carbon atoms. In one embodiment, the substituent of the acylated nitrogen compound has no more than an average of about 30 carbon atoms. The average number of carbon atoms is based on number average molecular weight.

The reactions usually occurs at a temperature from about 60° C. to about 200° C., about 90° C. to about 150° C. The reaction is typically accomplished in about 0.5 to about 10 hours, preferably about 2 to about 6, more preferably 4. An inert organic diluent, such as benzene, toluene, xylene, or mineral oil may be used.

The boron compound (A) and phospholipid (B) are reacted at an atomic proportion of boron to phosphorus of about (1:1) up to about (6:1), preferably about (2:1) up to about (4:1), more preferably about (3:1).

The boron compound (A) is reacted with the mixture of the phospholipid (B) and one or more of (C) through (G) in an amount of one atomic proportion of boron to equivalent of the mixture from about (1:1) to about (6:1), preferably about (2:1) to about (4:1), more preferably (3:1). The equivalents of the mixture are based on the combined equivalents of phospholipid (B) based on phosphorus and equivalents of (C) through (G). The equivalents of (C) through (F) are determined by the number of nitrogen atoms or hydroxyl groups. The equivalents of (G) are based on base number. Base number is the amount of potassium hydroxide or hydrochloric acid in milligrams necessary to neutralize one gram of same. The base number is converted to equivalent weight by the equation: equivalent weight= (56100/base number).

When the phospholipid (B) is reacted with a post-treated product of (C)–(G), then the phospholipid is reacted with the post-treated product at equivalent ratio of about (1:1) up to about (6:1), preferably about (2:1) up to about (4:1), more preferably about (3:1). The equivalents of the post-treated product are based on boron atoms.

The following examples illustrate the preparation of reaction products of a boron compound and a phospholipid. In the following examples as well as in the claims and specification, parts are parts by weight, degrees are degrees Celsius and pressure is atmospheric pressure unless otherwise indicated.

EXAMPLE 1

A reaction vessel is charged with 2195 parts (1.40 equivalents) of lecithin (a mixed phospholipid product from Central Soya Company of Fort Wayne, Ind., available commercially under the tradename Centrophase (typical analyses: % P=1.97, % N=0.75)), 396 parts of a 100 neutral mineral oil, and 260 parts (4.20 moles) of boric acid. The mixture is heated to 90° C. and the temperature is maintained at 90°–95° C. for 0.75 hour. A vacuum is applied and maintained at 160 millimeters of mercury for 2.25 hours during which time the reaction temperature rises from 95° C. to 120° C. and distillate is collected. The vacuum is decreased to 50 millimeters of mercury and the reaction temperature is held for an additional 1.25 hours at 120°– 125° C. (total reaction time equals 3.5 hours), while collecting 151 parts of distillate. A 100 neutral mineral oil (10 parts) is added to the residue and the residue is cooled to 55° C. and filtered through cloth. The filtrate has 1.52% phosphorus, 0.53% nitrogen, 1.78% boron and 15% oil.

EXAMPLE 2

A reaction vessel is charged with a mixture of 2600 parts (1.66 equivalent) of lecithin and 600 parts of toluene. Boric acid (307 parts, 4.97 moles) is added to the mixture over 0.5 hour at 40°–60° C. under nitrogen atmosphere. The reaction mixture is heated to reflux (130° C.) while removing 180 parts of water over 4 hours. A vacuum is applied (20 millimeters of mercury) and toluene solvent removed while raising the reaction temperature to 110° C. The residue is filtered through diatomaceous earth. The filtrate contains 1.78% P (1.88% theory), 0.71% N (0.72% theory) and 2.05% B (2.10% theory).

EXAMPLE 3

A reaction vessel is charged with a mixture of 800 parts (0.5 equivalent) corn lecithin (available as Corn Goodness UB from ADM Ross and Rowe), 150 parts toluene and 141 parts of a 100 neutral mineral oil. Boric acid (104 parts (1.68 moles)) is added over 0.5 hour at 40°–60° C. to the mixture. The reaction mixture is heated to reflux (125°–127° C.) for 4 hours while removing 63 parts distillate.

A vacuum is applied (20 millimeters of mercury) and toluene solvent removed while raising the temperature to 120° C. The residue is filtered through diatomaceous earth. The filtrate contains 1.55% P, 0.62% N, 1.1% B and 15% oil.

EXAMPLE 4

A reaction vessel is charged with 1562 parts (1 equivalent) of a lecithin of Example 1, 200 parts toluene and 560 parts (1 equivalent) of a 40% oil solution of a succinimide, which has 2.5% nitrogen and a total base number of 65 and is prepared by reacting a polyamine with a polyalkene succinic anhydride wherein the polyalkene has a number average molecular weight of approximately 1000. The mixture is heated to 50° C. with nitrogen sparging at 1 scfh where 247 parts (4 moles) of boric acid are added to the mixture over 0.25 hour. The mixture is heated to 120° C. where 25 parts of water are removed over 1.5 hours. The reaction is held at 120°–125° C. for 4.5 hours while 115 milliliters of distillate are obtained. The product is a clear, bright, deep red color. The mixture is vacuum stripped to 80° C. and 25 millimeters of mercury. The residue is a product which has 1.3% phosphorus (1.37% theory), 1.07% nitrogen (1.14% theory), 1.86% boron (1.95% theory), and 15% 100 neutral mineral oil.

EXAMPLE 5

A reaction vessel is charged with 1568 parts (1 equivalent) of the lecithin of Example 1 and 200 parts of textile spirits. The mixture is heated to 60° C. where 525 parts (3 equivalents) of a borated sodium sulfonate prepared by reacting 1 equivalent of boron with 1 equivalent of a sodium overbased alkylated benzene sulfonate having a metal ratio of 20 and containing 36% diluent (including 100 neutral mineral and unreacted alkylated benzene sulfonate) is added to the mixture. The reaction temperature is maintained at 60°–70° C. for 3 hours. The reaction mixture is vacuum stripped to 80° C. and 25 millimeters of mercury. The product contains 1.47% phosphorus (1.49% theory), 3.51% sodium (2.87% theory), 1.52% boron (1.57% theory) and a specific gravity of 1.04.

EXAMPLE 6

A reaction vessel is charged with 784 parts (0.5 equivalent) of the lecithin of Example 1, 124 parts (2.1 equivalents) of boric acid and 449 parts (1 equivalent) of a calcium overbased tall oil fatty acid having a metal ratio of 2, 58% 100 neutral mineral oil and a base number of 125. The mixture is heated to 90° C. and held for 1 hour. The reaction mixture is heated to 120° C. under 140 millimeters of mercury and the reaction is maintained at 120° C. for 1 hour. The reaction mixture is cooled to 60° C. and vacuum stripped at 60° C. and 40 millimeters of mercury. The residue has 1.12% phosphorus (1.19% theory), 1.63% calcium (1.60% theory), 1.97% boron (1.79% theory) and specific gravity of 1.02.

EXAMPLE 7

(A) A reaction vessel is charged with 389 parts (1 equivalent) of a sulfur-coupled tetrapropenyl phenol having 5% sulfur and 42% diluent as mineral oil, 200 parts of toluene and 20 parts (0.25 equivalent) of a 50% aqueous solution of sodium hydroxide. The mixture is stirred and heated to 80° C. where 33 parts (1.0 equivalent) of paraformaldehyde are added to the reaction vessel over 2 minutes and held for one-fourth hour.

(B) A reaction vessel is then charged with 1569 parts (1 equivalent) of the lecithin of Example 1 and 200 parts of toluene. The mixture is warmed to 40° C. where 185 parts (3 equivalents) of boric acid is added to the vessel over one-half hour with stirring. The reaction temperature is increased to 100° C. and maintained for three-fourths of an hour. The product contains 0.63% sulfur (0.67% theory), 1.31% phosphorus (1.37% theory), 1.34% boron (1.45% theory) and 10% 100 neutral mineral oil.

Lubricants

As previously indicated, the reaction products of a boron compound and a phospholipid of this invention are useful as additives for lubricants in which they can function primarily as antiwear, extreme pressure and/or friction modifying agents. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic transmission fluids, transaxle lubricants, gear lubricants, metal-working lubricants, hydraulic fluids and other lubricating oil and grease compositions can also benefit from the incorporation therein of the compositions of the present invention.

The borated phospholipid of the present invention may be used, in lubricants or in concentrates, by itself or in combination with any other known additive which includes, but is not limited to the above-described dispersants (acylated nitrogen-containing compounds, polyalkene amines, carboxylic esters, and Mannich products), the above-described detergents (overbased salts), antioxidants, anti-wear agents, extreme pressure agents, emulsifiers, demulsifiers, friction modifiers, anti-rust agents, corrosion inhibitors, viscosity improvers, pour point depressants, dyes, and solvents to improve handleability which may include alkyl and/or aryl hydrocarbons. When used separately as dispersants, the acylated nitrogen compounds are not limited to compounds with substituents having less than an average of 40 carbon atoms. These additives may be present in various amounts depending on the needs of the final product.

Antioxidants, corrosion inhibitors, extreme pressure and anti-wear agents include but are not limited to metal salts of a phosphorus acid, metal salts of a thiophosphorus acid or dithiophosphorus acid; organic sulfides and polysulfides; chlorinated aliphatic hydrocarbons; phosphorus esters including dihydrocarbyl and trihydrocarbyl phosphites; boron-containing compounds including borate esters; and molybdenum compounds.

Viscosity improvers include but are not limited to polyisobutenes, polymethyacrylate acid esters, polyacrylate acid esters, diene polymers, polyalkyl styrenes, alkenyl aryl conjugated diene copolymers, polyolefins and multifunctional viscosity improvers.

Pour point depressants are a particularly useful type of additive often included in the lubricating oils described herein. See for example, page 8 of "Lubricant Additives" by C. V. Smalheer and R. Kennedy Smith (Lesius-Hiles Company Publishers, Cleveland, Ohio, 1967).

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125– 162.

These and other additives are described in greater detail in U.S. Pat. No. 4,582,618 (column 14, line 52 through column 17, line 16, inclusive), herein incorporated by reference for its disclosure of other additives that may be used in combination with the present invention.

The concentrate might contain 0.01 to 90% by weight of the compositions of the present invention. These compositions may be present in a final product, blend or concentrate in any amount effective to act as an anti-wear agent, but is preferably present in oil of lubricating viscosity, hydraulic oils, fuel oils, gear oils or automatic transmission fluids in an amount of from about 0.1 to about 10%, preferably 0.1 to about 2% by weight, most preferably about 0.25% to about 1%. When the compositions of the present invention are used in gear oils, they are preferably present in an amount from about 0.1%, preferably about 1%, more preferably about 2% up to about 10%, preferably about 7%, preferably about 6% by weight of the lubricating composition.

The compositions, prepared by reacting (A) a boron compound with (B) a phospholipid, are useful as antiwear agents and extreme pressure agents in lubricants, especially gear, hydraulic and tractor lubricants.

The lubricating compositions and methods of this invention employ an oil of lubricating viscosity, including natural or synthetic lubricating oils and mixtures thereof. Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of dicarboxylic acids and polyols, esters of phosphorus-containing acids, polymeric tetrahydrofurans and silcon-based oils.

Specific examples of the oils of lubricating viscosity are described in U.S. Pat. No. 4,326,972 and European Patent Publication 107,282, both herein incorporated by reference for their disclosures relating to lubricating oils. A basic, brief description of lubricant base oils appears in an article by D. V. Brock, "Lubricant Base Oils", *Lubricant Engineering*, Volume 43, pages 184– 185, March, 1987. This article is herein incorporated by reference for its disclosures relating to lubricating oils. A description of oils of lubricating viscosity occurs in U.S. Pat. No. 4,582,618 (column 2, line 37 through column 3, line 63, inclusive), herein incorporated by reference for its disclosure to oils of lubricating viscosity.

In one embodiment, the borated phospholipids and derivatives thereof are useful in functional fluids generally known as tractor fluids. In general, a tractor fluid acts as a lubricant, a power transfer means and a heat transfer means. The fluid has important characteristics including the ability to provide proper frictional properties for preventing wet brake chatter while simultaneously providing the ability to actuate wet brakes and provide power take-off (PTO) clutch performance. A tractor fluid provides sufficient antiwear and extreme pressure properties as well as water tolerance/filterability capabilities. The inventors have found that the use of the reaction products of a boron compound and a phospholipid of the present invention together with a calcium salt, a metal dithiophosphate, and a carboxylic solubilizer provide to the fluid improved performances in the area of low temperature fluidity/filterability, EP/antiwear performance, friction improving properties, wet brake chatter suppression, and capacity with respect to actuating hydraulics, transmissions, power steering and braking without harming performance in other areas. These fluids exhibit an EP/antiwear performance without having undesirable effect on corrosion testing and transmission performance.

The calcium salt may be any calcium salt of the above-described acids (see above discussion of overbased salts). Preferably, the calcium salt is a calcium salt of an oil soluble sulfonic acid which is carbonated alone or in combination with a calcium alkyl phenate. In a preferred embodiment, the overbased metal salt is stabilized using a polybutene substituted succinic anhydride (described above as carboxylic acid acylating agent). A useful calcium salt may be prepared by the following procedure: 950 grams of a solution of a basic, carbonated calcium salt of an alkylated benzene sulfonic acid (average molecular weight 385) in a 100 neutral mineral oil (base number about 300, calcium equals 12.0% and sulfur equal 1.4%) is added to 50 grams polybutene (number average molecular weight 1000) substituted succinic anhydride post-treatment (having a suponification number of 100 at 25° C.). The mixture is stirred for 0.65 hour at 55°–57° C. and then at 152°–153° C. for 0.5 hour. The mixture is filtered at 150° C. The filtrate has a base number of 300 and contains 53% mineral oil.

The calcium salts are useful in providing improved characteristics in the areas of dispersancy and antirust and are used in tractor fluids in an amount from about 0.5 to about 5.5 parts by weight based on the weight of the fluid.

The EP/antiwear agent used in connection with the present invention includes a metal dithiophosphate. Preferably the metal includes a Group I metal, Group II metal, aluminum, tin, cobalt, copper, lead, molybdenum, manganese or nickel and zinc, preferably zinc. A dithiophosphate is prepared by a reaction of a dithiophosphoric acid with a metal-containing compound. A dithiophosphoric acid is prepared by reacting a phosphorus sulfide (phosphorus pentasulfide) with an alcohol or phenol. The reaction generally occurs between 20° C. and about 200° C. and 4 moles of alcohol or phenol is reacted with 1 mole of phosphorus pentasulfide. The alcohols generally contain from 1 to about 50 carbon atoms, preferably 1 to about 30, preferably 3 to about 18. The alcohols in a preferred embodiment contain 4 to about 8 carbon atoms. Examples of alcohols include propyl, butyl, methylpentyl, ethylhexyl, and octyl alcohols. Stearic arrangements of these alcohols are also included, i.e., butyl alcohol includes normal butyl alcohol and isobutyl alcohol. Mixtures of alcohols and phenols may be used.

In another embodiment, the EP/antiwear agent is a metal salt of a dithiophosphoric acid and a carboxylic acid. The dithiophosphoric acid is described above. The carboxylic acid may be a monocarboxylic or polycarboxylic acid, usually the polycarboxylic acid contains from 1 to about 3 carboxy groups. The carboxylic acids generally contain from about 2 to about 40 carbon atoms, preferably from about 2 to about 20 carbon atoms, and more preferably from about 5 to about 12 carbon atoms. The carboxylic acids are preferably free of acetylenic unsaturation. Examples of carboxylic acids include acetic, propionic, butanoic, pentanoic, hexanoic, octanoic, nonanoic, decanoic, dodecanoic, tetradecanoic, hexadecanoic, octadecanoic and eicosanoic acids. Examples of olefinic carboxylic acids include acrylic, oleic, linoleic and linolenic acids and dimers thereof. Preferably, the carboxylic acid is a saturated aliphatic monocarboxylic acid having a branched alkyl group such as 2-ethylhexanoic acid. Illustrative polycarboxylic acids include oxaloic, malonic, succinic, alkyl- and alkenyl-succinic, glutaric, adipic, pimelic, sebacic, maleic, fumaric and citric acids or anhydrides. The ratio of equivalents of dithiophosphoric acid to carboxylic acid is generally in the range of about 0.5:1 to about 1:0, preferably about 0.5:1 to about 500:1, more preferably about 5:1 to about 200:1, and still more preferably about 0.5:1 to about 100:1. When the carboxylic acid has more than about 3 carbon atoms, the ratio is preferred in the range of about 0.5:1 to about 50:1, preferably about 0.5:1 to about 20:1.

In a preferred embodiment, the metal dithiophosphates are reacted with phosphites and/or olefins. The phosphites are generally dialkyl phosphites wherein each alkyl group contains from 1 to about 12 carbon atoms, preferably up to about 10 carbon atoms. A triaryl phosphite (triphenylphosphite) is particularly useful in treating metal dithiophosphates.

The olefins used to treat the metal dithiophosphates contain from 3 to about 70 carbon atoms, preferably 8 to about 36, more preferably up to about 20 carbon atoms. These compounds are preferably aliphatic alphaolefins which are unbranched. Examples of these olefins include octene, nonene, decene, dodecene, tridecene, tetradecene, pentadecene, hexadecene and the like. Mixtures of commercially available alphaolefin mixtures include $C_{15-18}$ olefins, $C_{12-16}$ olefins, $C_{14-16}$ olefins, $C_{14-18}$ olefins, $C_{16-18}$ olefins, $C_{16-20}$ olefins, $C_{22-28}$ olefins, etc.

Metal dithiophosphates treated with olefins and phosphites are less likely to stain or corrode copper parts. The phosphites and olefin treatment remove the sulfur activity of such metal dithiophosphates. U.S. Pat. Nos. 4,263,150 and 4,507,215 describe metal dithiophosphates and their treatment with phosphite and olefin. These references are incorporated by reference for their disclosures to metal dithiophosphates, phosphites, olefins and methods of treating metal dithiophosphates.

The metal dithiophosphate is used in an amount to improve antiwear properties of the fluids and in tractor fluids is generally present in an amount from about 1% to about 4% by weight based on the weight of the fluid.

The fourth essential component of the tractor fluid is a carboxylic solubilizer. This component acts to provide a microemulsion of water particles, thus improving water tolerance and filterability. The carboxylic solubilizer is present in sufficient amounts to provide improved water tolerance and filterability and in a tractor fluid is present in an amount from about 0.1% to about 1% by weight based on the weight of the fluid. Examples of the carboxylic solubilizer are disclosed in U.S. Pat. No. 4,435,297 which is incorporated by reference for the purpose of disclosing carboxylic solubilizer and methods for making the same.

The carboxylic solubilizer used in connection with the present functional fluid are nitrogen-containing phosphorus free carboxylic acid derivatives. These derivatives are made by reacting a carboxylic acylating agent (disclosed above) with an alkanol tertiary amine (disclosed above). The most preferred carboxylic solubilizer is the product of a polybutylene succinic anhydride derived from a polybutene polymer having a number average molecular weight of about 1000 with N,N-diethylethanolamine at a molar ratio of 1:2. This product is predominantly an ester-salt and contains a small amount of diester. Further, the product may contain small amounts of free unreacted polybutene and trace amounts of maleic anhydride reacted with N,N-diethylethanolamine. A carboxylic solubilizer is obtained by reacting at a temperature of about 30° C. to the decomposition temperature of the components of the reaction mixture of a carboxylic acid acylating agent and an alkanol tertiary amine.

Lubricating oil compositions generally contain from about 0.5 to about 5.5 percent by weight of the composition of the above-described calcium salts. Preferably, the metal salt is present in an amount from about 1 to about 4 percent by weight, more preferably 2.5 to about 3.5, more preferably 3. The metal dithiophosphate is present in an amount from about 1 to about 4 percent by weight of the composition. Preferably, the metal dithiophosphate is present in an amount from about 1.5 to about 3, more preferably about 2. The carboxylic solubilizer is generally present in an amount from about 0.1 to about 1 percent by weight, preferably about 0.1 to about 0.75, more preferably 0.25 to about 0.5, more preferably 0.4. The reaction products of a boron compound and a phospholipid of the present invention are generally present in an amount from about 0.1 to about 1.5 percent by weight of the composition, preferably 0.25 to about 1.

The following examples illustrate lubricant formulations containing reaction products of a boron compound and a phospholipid.

EXAMPLE I

A lubricant is prepared by incorporating 2.82 percent by weight of an overbased calcium alkylated benzene sulfonate (having a metal ratio of about 15 and 53% diluent as 100 neutral mineral oil and unreacted alkylated benzene); 3.3% by weight of a zinc di(2-ethylhexyl) dithiophosphate; 1% by weight of the product of Example 1 and 0.5% by weight of a carboxylic acid derivative solubilizer prepared by reacting N,N-diethylethanol amine with polybutylene succinic anhydride at a molar ratio of 1:2 wherein the polybutene succinic anhydride contains a substituent derived from a polybutene polymer having a number average molecular weight of about 1000; 1.93% by weight of a maleic anhydride-styrene copolymer esterified with $C_{8-18}$ and $C_4$ alcohols and post-treated with amino propyl morpholine; and 0.02% by weight of a silicon anti-foam agent into an oil mixture containing 50% 250 neutral mineral oil and 50% 65 neutral mineral oil.

EXAMPLE II

A lubricant is prepared by incorporating 1.76 percent by weight of the overbased calcium sulfonate of Example I; 2.14 percent by weight of a zinc di(isooctyl) dithiophosphate treated with triphenylphosphite; 0.63 percent by weight of the product of Example 2 and 0.31 percent by weight of a carboxylic acid derivative solubilizer of Example I and including 1.93 percent by weight of a styrene/maleic anhydride VI improver of Example I; and 0.02 percent by weight of a silicon anti-foaming agent into an oil mixture containing 50% 250 neutral mineral oil and 50% 65 neutral mineral oil.

EXAMPLE III

A lubricant is prepared by incorporating 1.56 percent by weight of an overbased calcium sulfonate of Example I; 1.69 percent by weight of a zinc di(2-ethylhexyl)dithiophosphate- 2-ethylhexanoate prepared using zinc oxide, 2-ethylhexanoic acid, di(2-ethylhexyl)dithiophosphoric acid and triphenyl phosphite; 0.25 percent by weight of a carboxylic acid derivative solubilizer of Example I; 1.5 percent by weight of an esterified styrene/maleic anhydride copolymer of Example I; and 0.43 percent by weight of the product of Example 1 into an oil mixture containing 50% 250 neutral mineral oil and 560% 65 neutral mineral oil.

EXAMPLE IV

A lubricant is prepared by incorporating 1.41% of a calcium overbased sulfonate having a metal ratio of 14 and a total base number of 300, 1.9% of the zinc di(2-ethylhexyl)dithiophosphate- 2-ethylhexanoate of Example III; 0.25% of the carboxylic acid derivative solubilizer of Example I; 0.5% of the product of Example II; and 2.22% of the esterified styrene/maleic anhydride copolymer of Example I into an oil mixture composed of 50% by weight 250 neutral mineral oil and 50% by weight 65 neutral mineral oil.

EXAMPLE V

A lubricant is prepared by incorporating 1% of the product of Example 2; 0.01% tolyltriazole; 0.21% di(nonylphenol) amine; 0.25% 2,6-di-t-butylphenol; 0.03% of the reaction product of tetrapropenyl succinic anhydride and propylene glycol into 250 neutral mineral oil.

EXAMPLE VI

A lubricant is prepared as described in Example V except 0.75% by weight of the product of Example 4 is used in place of 1% of the product of Example 2.

EXAMPLE VII

A lubricant is prepared as described in Example V except 0.5% by weight of the product of Example VI is used in place of the product of Example 2.

EXAMPLE VIII

A lubricant is prepared by incorporating 5.5% by weight of the product of Example 2; 1% by weight of the esterified styrene/maleic anhydride copolymer of Example I; 0.2% silicone antifoam agent; 0.44% of the zinc di(2-ethylhexyl)dithiophosphate- 2-ethylhexanoate of Example III; 0.13% of a phenolic antioxidant available from Ethyl Corporation and known by the tradename antioxidant 733; 0.3% by weight of an overbased calcium sulfonate having a metal ratio of 1.2 and a total base number of 13; and 2% by weight of the reaction product of dibutyl amine, carbon disulfide and methyl acrylate into an oil mixture composed of 75% 600 neutral mineral oil and 25% 150 bright stock.

EXAMPLE IX

A lubricant is prepared as described in Example VIII except 5.0% by weight of the product of Example 4 is used in place of 5.5% by weight of the product of Example 2.

EXAMPLE X

A lubricant is prepared as described in Example VIII except 4% of the product of Example 6 is used in place of 5.5% by weight of the product of Example 2.

EXAMPLE XI

A lubricant is prepared by incorporating 1% of the product of Example 2; 0.3% of a polymethacrylate pour point depressant available from Shell Chemical Co. under the tradename Shellswim 140; 0.94% by weight of t-alkyl amine salt of a phosphate ester of a propylene oxide treated dimethylamyl dithiophosphate; 0.9% of oleyl amide; 0.03% of monoisopropyl amine; 0.06% of a silicon antifoam agent; 1.9% of the reaction product of isobutylene, sulfur monochloride, sodium sulfide and aqueous sodium hydroxide; 1.6% by weight of the reaction product of isobutylene, sulfur and hydrogen sulfide; 0.09% of a heptyl phenol dimercaptothiazole; and 0.38% by weight of a dimercaptothiazole treated reaction product of a polybutenyl succinic anhydride (equivalent weight 562) with pentaerythritol and propylene glycol which is post-treated with polyethylene amines into an oil mixture comprising 47% by weight 650 neutral mineral oil and 53% by weight 160 bright stock.

EXAMPLE XII

A lubricant is prepared as described in Example XI except 1.5% of the product of Example 4 is used in place of 1% of the product of Example 2.

EXAMPLE XIII

A lubricant is prepared as described in Example XI except 0.75% of the product of Example 6 is used in place of 1% of the product of Example 2.

EXAMPLE XIV

A lubricant is prepared as described in Example XI except 0.5% of the product of Example 2 and 0.5% of the product of Example 6 are used in place of 1% of the product of Example 2.

Aqueous Compositions

The invention also includes aqueous compositions characterized by an aqueous phase with at least one product of the present invention dispersed or dissolved in said aqueous phase. Preferably, this aqueous phase is a continuous aqueous phase although, in some embodiments, the aqueous phase can be a discontinuous phase. These aqueous compositions usually contain at least about 25% by weight water. Such aqueous compositions encompass both concentrates containing about 25% to about 80% by weight, preferably from about 40% to about 65% water; and water-based functional fluids containing generally over about 80% by weight of water. The concentrates generally contain less than about 50%, preferably less than about 25%, more preferably less than about 15%, and still more preferably less than about 6% hydrocarbon oil. The water-based functional fluids generally contain less than about 15%, preferably less than about 5%, and more preferably less than about 2% hydrocarbon oil.

These concentrates and water-based functional fluids can optionally include other conventional additives commonly employed in water-based functional fluids. These other additives include surfactants; thickeners; oil-soluble, water-insoluble functional additives such as antiwear agents, extreme pressure agents, dispersants, etc.; and supplemental additives such as corrosion-inhibitors, shear stabilizing agents, bactericides, dyes, water-softeners, odor masking agents, anti-foam agents and the like.

The water-based functional fluids may be in the form of solutions; or micelle dispersions or microemulsions which appear to be true solutions.

The surfactants that are useful in the aqueous compositions of the invention can be of the cationic, anionic, nonionic or amphoteric type. Many such surfactants of each type are known to the art. See, for example, McCutcheon's "Emulsifiers & Detergents", 1981 North American Edition, published by McCutcheon Division, MC Publishing Co., Glen Rock, N.J., U.S.A., which is hereby incorporated by reference for its disclosures in this regard.

Among the nonionic surfactant types are the alkylene oxide-treated products, such as ethylene oxide-treated phenols, alcohols, esters, amines and amides. Ethylene oxide/propylene oxide block copolymers are also useful nonionic surfactants. Glycerol esters and sugar esters are also known to be nonionic surfactants. A typical nonionic surfactant class useful with the present invention are the alkylene oxide-treated alkyl phenols such as the ethylene oxide alkyl phenol condensates sold by the Rohm & Haas Company. A specific example of these is Triton® X-100 which contains an average of 9–10 ethylene oxide units per molecule, has an HLB value of about 13.5 and a molecular weight of about 628.

The alkoxylated amines useful as surfactants Alkoxylated amines include polyalkoxylated amines and are available from Akzona Incorporated under the names ETHODUOMEEN® polyethoxylated diamines; ETHOMEEN®, polyethoxylated aliphatic amines; ETHOMID®, polyethoxylated amides; and ETHOQUAD, polyethoxylated quaternary ammonium chlorides.

The acids useful as surfactants are acids derived from tall oil acids, which is a distilled mixture of acids comprising chiefly oleic and linoleic acid. Preferred tall oil acids are mixtures of rosin acids and fatty acids sold under the trade name Unitol DT/40 (available from Union Camp Corp). Many other suitable nonionic surfactants are known; see, for example, the aforementioned McCutcheon's as well as the treatise "Non-Ionic Surfactants" edited by Martin J. Schick, M. Dekker Co., New York, 1967, which is herein incorporated by reference for its disclosures in this regard.

As noted above, cationic, anionic and amphoteric surfactants can also be used. Generally, these are all hydrophilic surfactants. A general survey of useful surfactants is found in Kirk-Othmer Encyclopedia of Chemical Technology, Second Edition, Volume 19, page 507 et seq. (1969, John Wiley and Son, New York) and the aforementioned compilation published under the name of McCutcheon's. These references are both hereby incorporated by reference for their disclosures relating to cationic, amphoteric and anionic surfactants.

Among the useful anionic surfactant types are the widely known carboxylate soaps, organo sulfates, sulfonates, sulfocarboxylic acids and their salts, and phosphates. Useful cationic surfactants include nitrogen compounds such as amine oxides and the well-known quaternary ammonium salts. Amphoteric surfactants include amino acid-type materials and similar types. Various cationic, anionic and amphoteric dispersants are available from the industry, particularly from such companies as Rohm & Haas and Union Carbide Corporation, both of America. Further information about anionic and cationic surfactants also can be found in the texts "Anionic Surfactants", Parts II and III, edited by W. M. Linfield, published by Marcel Dekker, Inc., New York, 1976 and "Cationic Surfactants", edited by E. Jungermann, Marcel Dekker, Inc., New York, 1976. Both of these references are incorporated by reference for their disclosures in this regard.

Surfactants are generally employed in effective amounts to aid in the dispersal of the various additives, particularly in the functional additives discussed below of the invention. Preferably, the concentrates can contain up to about 75% by weight, more preferably from about 10% to about 75% by weight of one or more of these surfactants. The water-based functional fluids can contain up to about 15% by weight, more preferably from about 0.05% to about 15% by weight of one or more of these surfactants.

Often the aqueous compositions of this invention contain at least one thickener. Generally, these thickeners can be polysaccharides, synthetic thickening polymers, or mixtures of two or more of these. Among the polysaccharides that are useful are natural gums such as those disclosed in "Industrial Gums" by Whistler and B. Miller, published by Academic Press, 1959. Disclosures in this book relating to water-soluble thickening natural gums is hereby incorporated by reference. Specific examples of such gums are gum agar, guar gum, gum arabic, algin, dextrans, xanthan gum and the like. Also among the polysaccharides that are useful as thickeners for the aqueous compositions of this invention are cellulose ethers and esters, including hydroxy hydrocarbyl cellulose and hydrocarbylhydroxy cellulose and its salts. Specific examples of such thickeners are hydroxyethyl cellulose and the sodium salt of carboxymethyl cellulose. Mixtures of two or more of any such thickeners are also useful.

It is a general requirement that the thickener used in the aqueous compositions of the present invention be soluble in both cold (10° C.) and hot (about 90° C.) water. This excludes such materials as methyl cellulose which is soluble in cold water but not in hot water. Such hot-water-insoluble materials, however, can be used to perform other functions such as providing lubricity to the aqueous compositions of this invention.

A thickener can also be synthetic thickening polymers. Many such polymers are known to those of skill in the art. Representative of them are polyacrylates, polyacrylamides, hydrolyzed vinyl esters, water-soluble homo- and interpolymers of acrylamidoalkane sulfonates containing 50 mole percent at least of acryloamido alkane sulfonate and other comonomers such as acrylonitrile, styrene and the like.

Other useful thickeners are known to those of skill in the art and many can be found in the list in the afore-mentioned McCutcheon Publication: "Functional Materials, " 1976 pp. 135–147, inclusive. The disclosures therein, relative to water-soluble polymeric thickening agents meeting the general requirements set forth above are hereby incorporated by reference.

Preferred thickeners, particularly when the compositions of the invention are required to be stable under high shear applications, are the water-dispersible reaction products formed by reacting at least one hydrocarbyl-substituted succinic acid and/or anhydride wherein the hydrocarbyl group has from about 8 to about 40 carbon atoms preferably has from about 8 to about 30, more preferably from about 12 to about 24, still more preferably from about 16 to about 18, with at least one water-dispersible amine terminated poly-(oxyalkylene) or at least one water-dispersible hydroxy-terminated polyoxyalkylene.

Examples of water-dispersible amine-terminated poly-(oxyalkylene)s that are useful in accordance with the present invention are disclosed in U.S. Pat. Nos. 3,021,232; 3,108,011; 4,444,566; and Re 31,522. The disclosures of these patents are incorporated herein by reference. Water-dispersible amine terminated poly(oxyalkylene)s that are useful are commercially available from the Texaco Chemical Company under the trade name Jeffamine®.

The water-dispersible hydroxy-terminated polyoxyalkylenes are constituted of block polymers of propylene oxide and ethylene oxide, and a nucleus which is derived from organic compounds containing a plurality of reactive hydrogen atoms. The block polymers are attached to the nucleus at the sites of the reactive hydrogen atoms. These compounds are commercially available from BASF Wyandotte Corporation under the tradename "Tetronic". Additional examples include the hydroxy-terminated polyoxyalkylenes which are commercially available from BASF Wyandotte Corporation under the tradename "Pluronic". Useful hydroxy-terminated polyoxyalkylenes are disclosed in U.S. Pat. Nos. 2,674,619 and 2,979,528, which are incorporated herein by reference.

The reaction between the succinic acid and/or anhydride and the amine- or hydroxy-terminated polyoxyalkylene can be carried out at a temperature in the range of about 60° C. to about 160° C., preferably about 120° C. to about 160° C. The ratio of equivalents of carboxylic agent to polyoxyalkylene preferably ranges from about 0.1:1 to about 8:1, preferably about 1:1 to about 4:1, and advantageously about 2:1. The reaction products may be used as salts or may form salts when added to concentrates and fluids containing metals or amines.

U.S. Pat. No. 4,659,492 is incorporated herein by reference for its teachings with respect to the use of hydrocarbyl-substituted succinic acid or anhydride/hydroxy-terminated poly(oxyalkylene) reaction products as thickeners for aqueous compositions.

When the thickener is formed using an amine-terminated poly(oxyalkylene), the thickening characteristics of said thickener can be enhanced by combining it with at least one surfactant. Any of the surfactants identified above can be used in this regard. When such surfactants are used, the weight ratio of thickener to surfactant is generally in the range of from about 1:5 to about 5:1, preferably from about 1:1 to about 3:1.

Typically, the thickener is present in a thickening amount in the aqueous compositions of this invention. When used, the thickener is preferably present at a level of up to about 70% by weight, preferably from about 20% to about 50% by weight of the concentrates of the invention. The thickener is preferably present at a level in the range of from about 1.5% to about 10% by weight, preferably from about 3% to about 6% by weight of the functional fluids of the invention.

The functional additives that can be used in the aqueous systems are typically oil-soluble, water-insoluble additives which function in conventional oil-based systems as extreme pressure agents, anti-wear agents, load-carrying agents, dispersants, friction modifiers, lubricity agents, etc. They can also function as anti-slip agents, film formers and friction modifiers. As is well known, such additives can function in two or more of the above-mentioned ways; for example, extreme pressure agents often function as load carrying agents.

The term "oil-soluble, water-insoluble functional additive" refers to a functional additive which is not soluble in water above a level of about 1 gram per 100 parts of water at 25° C., but is soluble in mineral oil to the extent of at least 1 gram per liter at 25° C.

These functional additives can also include certain solid lubricants such as graphite, molybdenum disulfide and polytetrafluoroethylene and related solid polymers.

These functional additives can also include frictional polymer formers. Polymer forming materials which are dispersed in a liquid are believed to polymerize under operating conditions. A specific example of such materials is dilinoleic acid and ethylene glycol combinations which can form a polyester frictional polymer film. These materials are known to the art and descriptions of them are found, for example, in the journal "Wear", Volume 26, pages 369–392, and West German Published Patent Application 2,339,065. These disclosures are hereby incorporated by reference for their discussions of frictional polymer formers.

Typically these functional additives are known metal or amine salts of organo sulfur, phosphorus, boron or carboxylic acids which are the same as or of the same type as used in oil-based fluids and are described above.

Many such functional additives are known to the art. For example, descriptions of additives useful in conventional oil-based systems and in the aqueous systems of this invention are found in "Advances in Petroleum Chemistry and Refining", Volume 8, edited by John J McKetta, Interscience Publishers, New York, 1963, pages 31–38 inclusive; Kirk-Othmer "Encyclopedia of Chemical Technology", Volume 12, Second Edition, Interscience Publishers, New York, 1967, page 575 et seq.; "Lubricant Additives" by M. W. Ranney, Noyes Data Corporation, Park Ridge, N.J., U.S.A., 1973; and "Lubricant Additives" by C. V. Smalheer and R. K. Smith, The Lezius-Hiles Co., Cleveland, Ohio, U.S.A. These references are hereby incorporated by reference for their disclosures of functional additives useful in the compositions of this invention.

The functional additive can also be a film former such as a synthetic or natural latex or emulsion thereof in water. Such latexes include natural rubber latexes and polystyrene butadienes synthetic latex.

The functional additive can also be an anti-chatter or anti-squawk agent. Examples of the former are the amide metal dithiophosphate combinations such as disclosed in West German Patent 1,109,302; amine salt-azomethene combinations such as disclosed in British Patent Specification 893,977; or amine dithiophosphate such as disclosed in U.S. Pat. No. 3,002,014. Examples of anti-squawk agents are N-acyl-sarcosines and derivatives thereof such as disclosed in U.S. Pat. Nos. 3,156,652 and 3,156,653; sulfurized fatty acids and esters thereof such as disclosed in U.S. Pat. Nos. 2,913,415 and 2,982,734; and esters of dimerized fatty acids such as disclosed in U.S. Pat. No. 3,039,967. The above-cited patents are incorporated herein by reference for their disclosure as pertinent to anti-chatter and anti-squawk agents useful as a functional additive in the aqueous systems of the present invention.

Typically, the functional additive is present in a functionally effective amount. The term "functionally effective amount" refers to a sufficient quantity of an additive to impart desired properties intended by the addition of said additive. For example, if an additive is a rust-inhibitor, a functionally effective amount of the rust-inhibitor would be an amount sufficient to increase the rust-inhibiting characteristics of the composition to which it is added.

The aqueous systems of this invention often contain at least one optional inhibitor for corrosion of either ferrous or non-ferrous metals or both. The optional inhibitor can be organic or inorganic in nature. Many suitable inorganic inhibitors useful in the aqueous systems of the present invention are known to those skilled in the art. Included are those described in "Protective Coatings for Metals" by Burns and Bradley, Reinhold Publishing Corporation, Second Edition, Chapter 13, pages 596–605. This disclosure relative to inhibitors are hereby incorporated by reference. Specific examples of useful inorganic inhibitors include alkali metal nitrites, sodium di- and tripolyphosphate, potassium and dipotassium phosphate, alkali metal borate and mixtures of the same. Specific examples of organic inhibitors include hydrocarbyl amine and hydroxy-substituted hydrocarbyl amine neutralized acid compound, such as neutralized phosphates and hydrocarbyl phosphate esters, neutralized fatty acids, neutralized aromatic carboxylic acids (e.g., 4-tertiarybutyl benzoic acid), neutralized naphthenic acids and neutralized hydrocarbyl sulfonates. Particularly useful amines include the alkanolamines such as ethanol amine, diethanolamine.

The aqueous systems of the present invention can also include at least one bactericide. Such bactericides are well known to those of skill in the art and specific examples can be found in the afore-mentioned McCutcheon publication "Functional Materials" under the heading "Antimicrobials" on pages 9–20 thereof. This disclosure is hereby incorporated by reference as it relates to suitable bactericides for use in the aqueous compositions or systems of this invention. Generally, these bactericides are water-soluble, at least to the extent to allow them to function as bactericides.

The aqueous systems of the present invention can also include such other materials as dyes, e.g., an acid green dye; water softeners, e.g., ethylene diamine tetraacetate sodium salt or nitrilo triacetic acid; odor masking agents, e.g., citronella, oil of lemon, and the like; and anti-foamants, such as the well-known silicone anti-foamant agents.

The aqueous systems of this invention may also include an anti-freeze additive where it is desired to use the composition at a low temperature. Materials such as ethylene glycol and analogous polyoxyalkylene polyols can be used as anti-freeze agents. Clearly, the amount used will depend on the degree of anti-freeze protection desired and will be known to those of ordinary skill in the art.

It should also be noted that many of the ingredients described above for use in making the aqueous systems of this invention are industrial products which exhibit or confer more than one property on such aqueous compositions. Thus, a single ingredient can provide several functions thereby eliminating or reducing the need for some other additional ingredient. Thus, for example, an extreme pressure agent such as tributyl tin oxide can also function as a bactericide.

Discussion of aqueous compositions and components of aqueous systems occurs in U.S. Pat. No. 4,707,301, herein incorporated by reference for its disclosure of aqueous compositions and components of aqueous compositions.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A composition, prepared by reacting a combination consisting essentially of (A) at least one boron compound selected from the group consisting of boron oxide, boron oxide hydrate, boron trioxide, boron trifluoride, boron tribromide, boron trichloride, boron acids, boric acid, tetraboric acid, metaboric acid, boron anhydride, boron amide, esters of boron acids and complexes of boron trihalide and (B) at least one phospholipid.

2. The composition of claim 1, wherein the phospholipid (B) is a mono- or diacyl glycerophospholipid.

3. The composition of claim 1, wherein the phospholipid (B) is a mono- or diacyl phosphatidylcholine, phosphatidylethanol, phosphatidylserine, phosphatidylinositol, phosphatidic acid or mixtures thereof.

4. The composition of claim 2, wherein each acyl group is independently derived from myristic acid, palmitic acid, stearic acid, oleic acid, linoleic acid, linolenic acid, arachidic acid, arachidonic acid or mixtures thereof.

5. The composition of claim 2, wherein the acyl group is independently derived from stearic acid, oleic acid, linoleic acid, linolenic acid or mixtures thereof.

6. The composition of claim 1, wherein the phospholipid (B) is at least one lecithin.

7. The composition of claim 6, wherein the phospholipid (B) is at least one lecithin derived from soybean, cotton seed, corn, rapeseed, sunflower seed, peanut, palm kernel, cucurbic, what, barley, rice, olive, mango avocado, papaya, and carrot.

8. The composition of claim 1, wherein the boron compound (A) is boric acid.

9. A lubricating composition, comprising a major amount of at least one oil of lubricating viscosity and a minor amount of the composition of claim 1.

10. The composition of claim 9, wherein the lubricating composition is a crankcase oil, a hydraulic oil, a tractor fluid., an automatic transmission fluid, or a gear oil.

11. An aqueous composition, comprising water and the composition of claim 1.

12. The composition of claim 11, wherein the composition is an aqueous functional fluid.

13. A composition, prepared by reacting a combination consisting essentially of boron oxide, boron oxide hydrate, boron trioxide, boron trifluoride, boron trichloride, boron acids, boric acid, tetraboric acid, metaboric acid, boron anhydride, boron amide, esters of boron acids and complexes of boron trihalide, (B) at least one phospholipid and further at least one compound selected from the group consisting of (C) at least one amine (E) a carboxylic ester, (F) Mannich reaction products, or (G) a basic or neutral metal salt of an organic acid.

14. The composition of claim 13 wherein the carboxylic ester (E) is a reaction product of a hydroxy compound and a hydrocarbyl-substituted acylating agent having a hydrocarbyl group containing at least about 8 carbon atoms.

15. The composition of claim 14, wherein the hydroxy compound contains from 1 to about 10 hydroxyl groups and from about 2 to about 20 carbon atoms.

16. The composition of claim 14, wherein the hydrocarbyl group is derived from a polyalkene having a number average molecular weight from about 500 to about 3000.

17. The composition of claim 13 wherein the basic or neutral metal salt (G) is a neutral or basic alkali, alkaline earth or transition metal salt of an organic acid.

18. The composition of claim 17, wherein the organic acid is a sulfonic acid, carboxylic acid, or a phenol.

19. A lubricating composition, comprising a major amount of at least one oil of lubricating viscosity and a minor amount of the composition of claim 13.

20. The composition of claim 19, wherein the lubricating composition is a crankcase oil, a hydraulic oil, a tractor fluid, an automatic transmission fluid, or a gear oil.

21. An aqueous composition, comprising water and the composition of claim 13.

22. The composition of claim 13, wherein the phospholipid (B) is a mono-or diacyl glycerophospholipid.

23. The composition of claim 13, wherein the phospholipid (B) is a mono-or diacyl phosphatidylcholine, phosphatidylethanol, phosphatidylserine, phosphatidylinositol, phosphatidic acid or mixtures thereof.

24. The composition of claim 22, wherein each acyl group is independently derived from myristic acid, palmitic acid, stearic acid, oleic acid, linoleic acid, linolenic acid, arachidic acid, arachidonic acid or mixtures thereof.

25. The composition of claim 22, wherein the acyl group is independently derived from stearic acid, oleic acid, linoleic acid, linolenic acid or mixtures thereof.

26. The composition of claim 13, wherein the phospholipid (B) is at least one lecithin.

27. The composition of claim 26, wherein the phospholipid (B) is at least one lecithin derived from soybean, cotton seed, corn, rapeseed, sunflower seed, peanut, palm kernel, cucurbic, wheat, barley, rice, olive, mango, avocado, papaya, and carrot.

28. The composition of claim 13 wherein the boron compound (A) is boric acid.

29. A composition prepared by reacting a boron compound A selected from the group consisting of boron oxide, boron oxide hydrate, boron trioxide, boron trifuoride, boron tribromide, boron trichloride, boron acids, boric acid, tetraboric acid, metaboric acid, boron arkhydride, boron amide, esters of boron acids and complexes of boron trihalide with a mixture of phospholipid (B) and at least one compound selected from the group consisting of an amine (C), a carboxylic ester (E). a Mannich reaction product (F), or a neutral or basic metal salt of an organic acid (G).

30. A lubricating composition, comprising a major amount of at least one oil of lubricating viscosity and a minor amount of the composition of claim 29.

31. The composition of claim 30, wherein the lubricating composition is a crankcase oil, a hydraulic oil, a tractor fluid, an automatic transmission fluid, or a gear oil.

32. A composition prepared by reacting a boron compound (A) selected from the group consisting of boron oxide, boron oxide hydrate, boron trioxide, boron trifuoride, boron tribromide, boron trichloride, boron acids, boric acid, tetraboric acid, metaboric acid, boron anhydride, boron amide, esters of boron acids and complexes of boron trihalide with at least one compound selected from the group consisting of an amine (C), a carboxylic ester (E), a Mannich reaction product (F) or a neutral or basic metal salt of an organic acid (G) to form an intermediate, and then reacting the intermediate with a phospholipid (B).

33. A lubricating composition, comprising a major amount of at least one oil of lubricating viscosity and a minor amount of the composition of claim 32.

34. The composition of claim 33, wherein the lubricating composition is a crankcase oil, a hydraulic oil, a tractor fluid, an automatic transmission fluid, or a gear oil.

35. A lubricating composition, comprising a major amount of an oil of lubricating viscosity and a minor amount of a neutral or basic alkali, alkaline earth or transition metal salt of an organic acid, a metal dithiophosphate, a carboxylic solubilizer and a composition prepared by reacting (A) at least one boron compound selected from the group consisting of boron oxide, boron oxide hydrate, boron trioxide, boron trifluoride, boron tribromide, boron trichloride, boron acids, boric acid, tetraboric acid, metaboric acid, boron anhydride, boron amide, esters of boron acids and complexes of boron trihalide and (B) at least one phospholipid.

36. The composition of claim 35, wherein the neutral or basic metal salt is an overbased calcium sulfonate.

37. The composition of claim 35, wherein the carboxylic solubilizer is the reaction product of an amine and a hydrocarbyl-substituted carboxylic acylating agent with a hydrocarbyl group derived from a polyalkene having a number average molecular weight from about 500 to about 3000.

38. The composition of claim 35, wherein the carboxylic solubilizer is an ester or ester-salt of a hydrocarbyl-substituted carboxylic acylating agent and an alkanolamine.

* * * * *